US010513116B2

(12) United States Patent
Kubota et al.

(10) Patent No.: US 10,513,116 B2
(45) Date of Patent: Dec. 24, 2019

(54) LIQUID EJECTING HEAD AND LIQUID EJECTING APPARATUS

(71) Applicant: SII Printek Inc., Chiba-shi, Chiba (JP)

(72) Inventors: Yuzuru Kubota, Chiba (JP); Daichi Nishikawa, Chiba (JP); Daiki Irokawa, Chiba (JP); Eriko Maeda, Chiba (JP); Yutaka Hongo, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 15/883,812

(22) Filed: Jan. 30, 2018

(65) Prior Publication Data

US 2018/0222196 A1 Aug. 9, 2018

(30) Foreign Application Priority Data

Feb. 3, 2017 (JP) ..... 2017-018237

(51) Int. Cl.

*B41J 2/045* (2006.01)
*B41J 2/14* (2006.01)
*B41J 2/16* (2006.01)

(52) U.S. Cl.

CPC ..... *B41J 2/14209* (2013.01); *B41J 2/1433* (2013.01); *B41J 2/1609* (2013.01); *B41J 2/1623* (2013.01); *B41J 2/1626* (2013.01); *B41J 2/1631* (2013.01); *B41J 2/1632* (2013.01); *B41J 2/1643* (2013.01); *B41J 2002/14362* (2013.01); *B41J 2002/14419* (2013.01); *B41J 2002/14491* (2013.01); *B41J 2202/12* (2013.01)

(58) Field of Classification Search

None

See application file for complete search history.

(56) References Cited

U.S. PATENT DOCUMENTS 5,835,110 A * 11/1998 Sasaki ..... B41J 2/14129 347/40
6,179,412 B1 * 1/2001 Ishinaga ..... B41J 2/14145 347/63
8,091,987 B2 * 1/2012 Van Den Bergen ..... B41J 2/14209 347/65

OTHER PUBLICATIONS

Koseki Osamu, Head Chip, Liquid Jet Head and Liquid Jet Device, Dec. 2009, EP (Year: 2009).*

* cited by examiner

*Primary Examiner* — Matthew Luu
*Assistant Examiner* — Tracey M McMillion
(74) *Attorney, Agent, or Firm* — Brinks Gilson & Lione

(57) ABSTRACT

According to an embodiment, an ink jet head includes a pair of actuator plates, a return plate, and a flow passage plate. The pair of actuator plates are disposed to face each other in a Y-direction. In the actuator plate, a plurality of channels which extend in a Z-direction are arranged at a distance in an X-direction. The return plate is disposed on an opening end side of the channels in the pair of actuator plates. A circulation passage which communicates with the channels is formed in the return plate. The flow passage plate is disposed between the pair of actuator plates. An inlet flow passage into which an ink flows and an outlet flow passage which communicates with the circulation passage are arranged in the Z-direction.

15 Claims, 19 Drawing Sheets

LIQUID EJECTING HEAD AND LIQUID EJECTING APPARATUS

RELATED APPLICATIONS

This application claims priority under 35 U.S.C. § 119 to Japanese Patent Application No. 2017-018237 filed on Feb. 3, 2017, the entire content of which is hereby incorporated by reference.

BACKGROUND OF THE INVENTION

Field of the Invention

The present invention relates to a liquid ejecting head and a liquid ejecting apparatus.

Background Art

In the related art, as an apparatus that records an image or letters on a recording medium by discharging a droplet-like ink to the recording medium such as a recording sheet, an ink jet printer (liquid ejecting apparatus) including an ink jet head (liquid ejecting head) is provided.

For example, U.S. Pat. No. 8,091,987 discloses a configuration in which a pump room is arranged on an inner side, an ink is introduced from an outside, and the ink is brought back to the outside, in a two-row type ink jet head in which two rows of nozzle holes are arranged.

However, if the configuration in which the pump room is arranged on the inner side, an ink is introduced from the outside, and the ink is brought back to the outside is applied, two sets of flow passages for the ink are required. Thus, the thickness of the ink jet head becomes thick and the weight thereof may be increased.

SUMMARY OF THE INVENTION

To solve the above problem, an object of the present invention is to provide a liquid ejecting head and a liquid ejecting apparatus which can reduce the weight by reducing the thickness.

According to an aspect of the present invention, a liquid ejecting head includes a pair of actuator plates, a return plate, and a flow passage plate. The pair of actuator plates are disposed to face each other in a third direction orthogonal to a first direction and a second direction. In the actuator plate, a plurality of channels which extend in the first direction are arranged at a distance in the second direction which is orthogonal to the first direction. The return plate is disposed on an opening end side of the channels in the pair of actuator plates. In the return plate, a circulation passage which communicates with the channels is formed. The flow passage plate is disposed between the pair of actuator plates. In the flow passage plate, an inlet flow passage into which a liquid flows and an outlet flow passage which communicates with the circulation passage are formed to be arranged in the first direction.

According to this configuration, since the flow passage plate which is disposed between the pair of actuator plates and in which the inlet flow passage into which a liquid flows and the outlet flow passage which communicates with the circulation passage are formed to be arranged in the first direction is provided, it is possible to concentrate the flow passages of a liquid between the pair of actuator plates. Therefore, in comparison to a configuration in which a liquid is introduced from the outside and the liquid is brought back to the outside, two sets of flow passages for a liquid are not required, and it is possible to reduce the thickness of the liquid ejecting head (length of the liquid ejecting head in the third direction). Accordingly, it is possible to provide a liquid ejecting head which can reduce the thickness and the weight.

In the liquid ejecting head, the inlet flow passage may include an inlet liquid storage portion which extends in the second direction and temporarily stores the liquid before the liquid flows into the channel.

According to this configuration, since the inlet liquid storage portion which extends in the second direction is provided, it is possible to transfer heat through a liquid. Thus, it is easy to cause the temperature of the actuator plate to be uniform.

In the liquid ejecting head, the outlet flow passage may include an outlet liquid storage portion which extends in the second direction and temporarily stores a liquid flowing out from the circulation passage.

According to this configuration, since the outlet liquid storage portion which extends in the second direction is provided, it is possible to transfer heat through a liquid. Thus, it is easy to cause the temperature of the actuator plate to be uniform.

In the liquid ejecting head, the inlet flow passage may be opened on one end surface of the flow passage plate in the second direction.

According to this configuration, in comparison to a case where the inlet flow passage is opened on one end surface of the flow passage plate in the first direction, it is possible to reduce the length of the liquid ejecting head in the first direction, on an inflow side of a liquid. In addition, in comparison to a case where the inlet flow passage is opened on one end surface of the flow passage plate in the third direction, it is possible to reduce the thickness of the liquid ejecting head (length of the liquid ejecting head in the third direction) on the inflow side of the liquid.

In the liquid ejecting head, the outlet flow passage may be opened on the other end surface of the flow passage plate in the second direction.

According to this configuration, in comparison to a case where the outlet flow passage is opened on one end surface of the flow passage plate in the first direction, it is possible to reduce the length of the liquid ejecting head in the first direction, on an outflow side of a liquid. In addition, in comparison to a case where the outlet flow passage is opened on one end surface of the flow passage plate in the third direction, it is possible to reduce the thickness of the liquid ejecting head (length of the liquid ejecting head in the third direction) on the outflow side of the liquid.

In the liquid ejecting head, when a cross-sectional area of the channel when a portion of the channel, which faces the return plate is cut out along a plane orthogonal to a flowing direction of the liquid is set to be a channel-side flow passage cross-sectional area, and a cross-sectional area of the circulation passage when the circulation passage is cut out along a plane orthogonal to the flowing direction of the liquid is set to be a circulation passage-side flow passage cross-sectional area, the circulation passage-side flow passage cross-sectional area may be smaller than the channel-side flow passage cross-sectional area.

According to this configuration, in comparison to a case where the circulation passage-side flow passage cross-sectional area is greater than the channel-side flow passage cross-sectional area, it is possible to suppress an occurrence of so-called crosstalk (crosstalk from the circulation passage side) in which pressure fluctuation in a channel, which occurs when a liquid is ejected, propagates as a pressure wave, to another channel through the flow passage. Thus, it is possible to obtain excellent liquid ejection performance (printing stability).

In the liquid ejecting head, an inlet flow-passage partition wall which partitions the inlet flow passage into a side of one of the pair of actuator plates and a side of the other of the pair of actuator plates in the third direction may be provided in the flow passage plate.

According to this configuration, pressure fluctuation in a channel, which occurs when a liquid is ejected is blocked by the inlet flow-passage partition wall. Thus, it is possible to suppress the occurrence of so-called crosstalk in which the pressure fluctuation propagates as a pressure wave, to another channel and the like through the flow passage between the actuator plates. Thus, it is possible to obtain excellent liquid ejection performance (printing stability).

In the liquid ejecting head, an outlet flow-passage partition wall which partitions the outlet flow passage into a side of one of the pair of actuator plates and a side of the other of the pair of actuator plates in the third direction may be provided in the flow passage plate.

According to this configuration, pressure fluctuation in a channel, which occurs when a liquid is ejected is blocked by the outlet flow-passage partition wall. Thus, it is possible to suppress the occurrence of so-called crosstalk in which the pressure fluctuation propagates as a pressure wave, to another channel and the like through the flow passage between the actuator plates. Thus, it is possible to obtain excellent liquid ejection performance (printing stability).

In the liquid ejecting head, an inlet flow-passage forming member which forms the inlet flow passage in the flow passage plate may be formed of a material having thermal conductivity which is equal to or greater than that of the actuator plate.

According to this configuration, it is possible to reduce temperature variation at a portion of a part between the actuator plates, which overlaps the inlet flow-passage forming member of the flow passage plate in the third direction, and to cause the temperature of a liquid to be uniform. Thus, it is possible to cause an ejection speed of a liquid to be uniform and to improve printing stability.

In the liquid ejecting head, an outlet flow-passage forming member which forms the outlet flow passage in the flow passage plate may be formed of a material having thermal conductivity which is equal to or greater than that of the actuator plate.

According to this configuration, it is possible to reduce temperature variation at a portion of a part between the actuator plates, which overlaps the outlet flow-passage forming member of the flow passage plate in the third direction, and to cause the temperature of a liquid to be uniform. Thus, it is possible to cause an ejection speed of a liquid to be uniform and to improve printing stability.

In the liquid ejecting head, the flow passage plate may be integrally formed of the same member.

According to this configuration, in comparison to a case where the flow passage plate is formed by an assembly of a plurality of members, it is possible to reduce manufacturing man-hours of the flow passage plate. In addition, in comparison to a case where the flow passage plate is formed by an assembly of a plurality of members, it is possible to improve dimensional accuracy of the flow passage plate.

The liquid ejecting head may further include a pair of cover plates which is disposed to face each other in the third direction with the flow passage plate interposed between the pair of cover plates. In the cover plate, a liquid supply passage which penetrates the cover plate in the third direction and communicates with the channel is formed. The cover plate is stacked on a first main surface of the actuator plate in the third direction so as to close the plurality of channels in the actuator plate.

According to this configuration, since the pair of cover plates are further included, it is possible to concentrate flow passages of a liquid, which includes the liquid supply passage, between the pair of actuator plates. Therefore, in comparison to a configuration in which a liquid is introduced from the outside and the liquid is brought back to the outside, it is possible to reduce the thickness of the liquid ejecting head (length of the liquid ejecting head in the third direction) as thin as possible.

In the liquid ejecting head, the cover plate may be formed of a material having thermal conductivity which is equal to or greater than that of the actuator plate and is equal to or smaller than that of the flow passage plate.

According to this configuration, it is possible to reduce temperature variation at a portion of a part between the actuator plates, which overlaps the cover plate in the third direction, and to cause the temperature of a liquid to be uniform. Thus, it is possible to cause an ejection speed of a liquid to be uniform and to improve printing stability.

In the liquid ejecting head, a first main surface of the cover plate on a side which is opposite to the flow passage plate side in the third direction may be configured to be a connection surface to which an external wiring is connected.

According to this configuration, in comparison to a case where a second main surface of the cover plate on the flow passage plate side of the cover plate in the third direction is configured to be the connection surface, it is possible to easily perform connection work between the external wiring and an electrode terminal on the connection surface.

In the liquid ejecting head, a tail portion of the cover plate, which has the connection surface and extends out of one end surface of the actuator plate in the first direction in a stacked state of the actuator plate and the cover plate may be provided in the cover plate. A portion of the flow passage plate, which overlaps the tail portion in the third direction may be set to be a solid member.

According to this configuration, in comparison to a case where a portion of the flow passage plate, which overlaps the tail portion of the cover plate in the third direction is set to be a hollow member, it is possible to avoid poor crimping occurring by a space between members at a time of connection, when the flow passage plate and the cover plate are connected to each other.

In the liquid ejecting head, a first main surface of the cover plate on a side which is opposite to the flow passage plate side in the third direction may be configured to be a connection surface to which an external wiring is connected. A tail portion of the cover plate which has the connection surface and extends out of one end surface of the actuator plate in the first direction in a stacked state of the actuator plate and the cover plate may be provided in the cover plate. A portion of the flow passage plate, which overlaps the tail portion in the third direction may be set to be a solid member.

According to this configuration, in comparison to a case where a second main surface of the cover plate on the flow passage plate side in the third direction is configured to be the connection surface, it is possible to easily perform connection work between the external wiring and an electrode terminal on the connection surface. In addition, in comparison to a case where a portion of the flow passage plate, which overlaps the tail portion of the cover plate in the third direction is set to be the hollow member, it is possible to avoid poor crimping occurring by a space between members at a time of connection, when the flow passage plate and the cover plate are connected to each other.

According to another aspect of the present invention, a liquid ejecting apparatus includes the liquid ejecting head and a moving mechanism. The moving mechanism relatively moves the liquid ejecting head and a recording medium.

According to this configuration, in a liquid ejecting apparatus including the two-row type liquid ejecting head, it is possible to reduce the thickness and the weight of the liquid ejecting head.

According to the present invention, it is possible to provide a liquid ejecting head and a liquid ejecting apparatus which can reduce the weight by reducing the thickness.

DETAILED DESCRIPTION OF THE INVENTION

Figure 1:
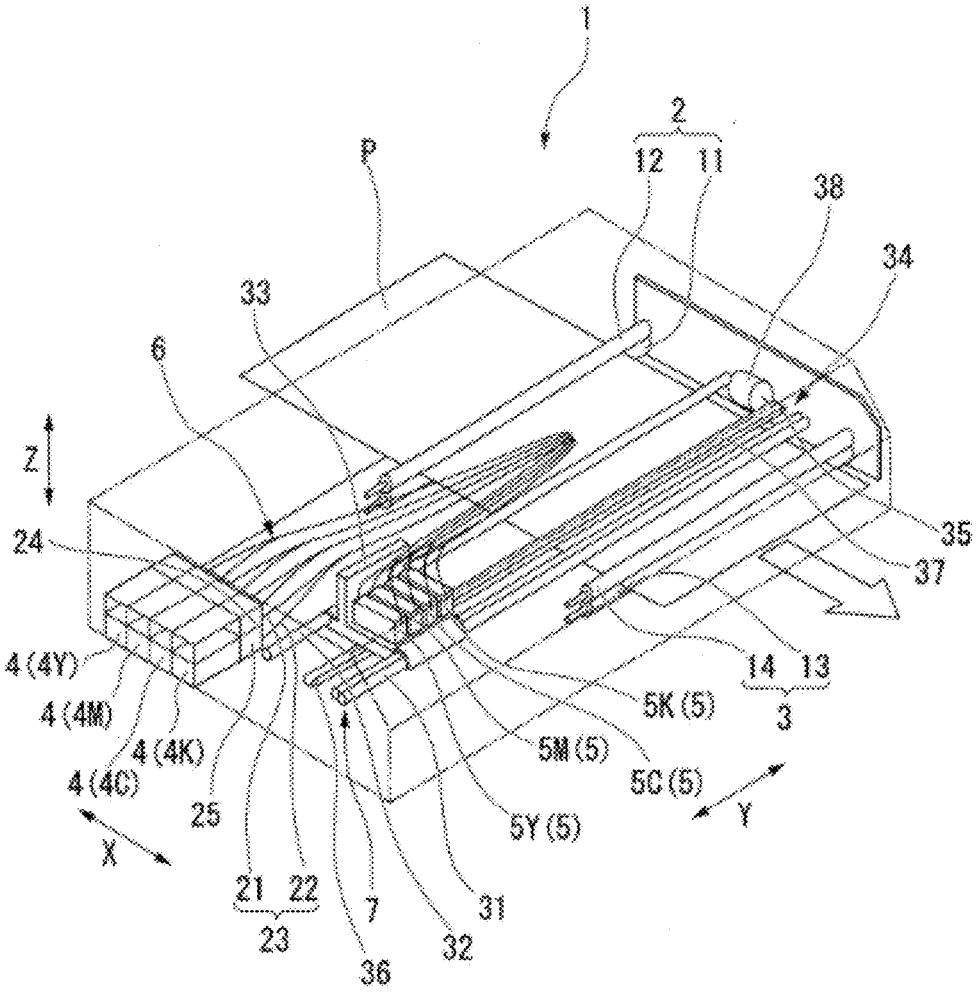
FIG. 1 is a schematic configuration diagram illustrating an ink jet printer according to an embodiment.

Hereinafter, an embodiment according to the present invention will be described with reference to the drawings. In the embodiment, as an example of a liquid ejecting apparatus which includes a liquid ejecting head including a liquid ejecting head chip (simply referred to as "a head chip" below) according to the present invention, an ink jet printer (simply referred to as "a printer" below) that performs recording on a recording medium by using an ink (liquid) will be described. In the drawings used in the following descriptions, members are assumed to have a size which allows recognition of each of the members. Thus, the scale of each of the members is appropriately changed.

Printer

FIG. 1 is a schematic configuration diagram illustrating a printer 1.

As illustrated in FIG. 1, the printer 1 in the embodiment includes a pair of transporting means 2 and 3, an ink tank 4, an ink jet head (liquid ejecting head) 5, ink circulation means 6, and scanning means 7. In the following descriptions, descriptions will be made, if necessary, by using an orthogonal coordinates system of X, Y, and Z. An X-direction is a transport direction of a recording medium P (for example, paper). A Y-direction is a scanning direction of the scanning means 7. A Z-direction is a vertical direction which is orthogonal to the X-direction and the Y-direction.

The transporting means 2 and 3 transport the recording medium P in the X-direction. Specifically, the transporting means 2 includes a grit roller 11, a pinch roller 12, and a driving mechanism (not illustrated) such as a motor. The grit roller 11 is provided to extend in the Y-direction. The pinch roller 12 is provided to extend in parallel to the grit roller 11. The driving mechanism axially rotates the grit roller 11. The transporting means 3 includes a grit roller 13, a pinch roller 14, and a driving mechanism (not illustrated). The grit roller 13 is provided to extend in the Y-direction. The pinch roller 14 is provided to extend in parallel to the grit roller 13. The driving mechanism (not illustrated) axially rotates the grit roller 13.

A plurality of ink tanks 4 are provided to be arranged in one direction. In the embodiment, the plurality of ink tanks 4 respectively correspond to ink tanks 4Y, 4M, 4C, and 4K that accommodate inks of four colors which are yellow, magenta, cyan, and black. In the embodiment, the ink tanks 4Y, 4M, 4C, and 4K are disposed side by side in the X-direction.

Figure 2:
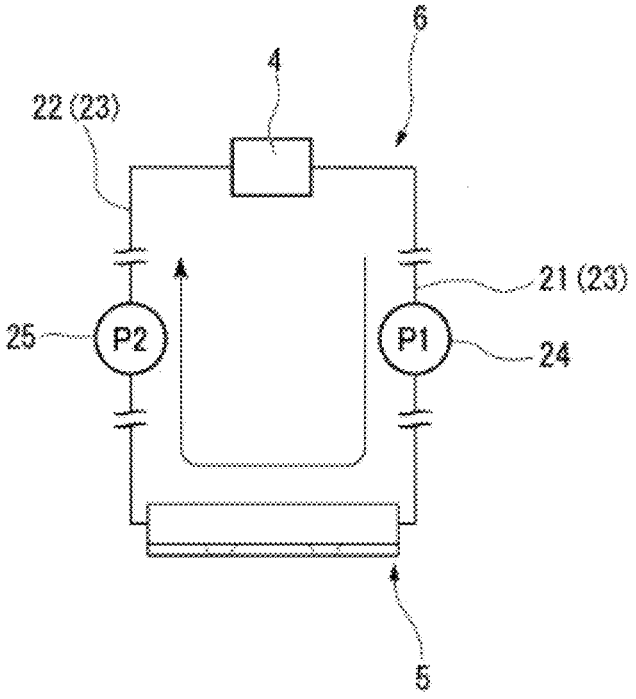
FIG. 2 is a schematic configuration diagram illustrating an ink jet head and ink circulation means in the embodiment.

As illustrated in FIG. 2, the ink circulation means 6 is configured to circulate an ink between the ink tank 4 and the ink jet head 5. Specifically, the ink circulation means 6 includes a circulation flow passage 23, a pressure pump 24, and a suction pump 25. The circulation flow passage 23 includes an ink supply tube 21 and an ink discharge tube 22. The pressure pump 24 is connected to the ink supply tube 21. The suction pump 25 is connected to the ink discharge tube 22. For example, the ink supply tube 21 and the ink discharge tube 22 are configured by a flexible hose which has flexibility and can follow an operation of the scanning means 7 for supporting the ink jet head 5.

The pressure pump 24 applies pressure to the inside of the ink supply tube 21, and thus an ink is sent to the ink jet head 5 through the ink supply tube 21. Thus, the ink supply tube 21 side has positive pressure in comparison to the ink jet head 5.

The suction pump 25 depressurizes the ink discharge tube 22, and thus suctions an ink from the ink jet head 5 through the ink discharge tube 22. Thus, the ink discharge tube 22 side has negative pressure in comparison to the ink jet head 5. The ink may be circulated between the ink jet head 5 and the ink tank 4 through the circulation flow passage 23, by driving of the pressure pump 24 and the suction pump 25.

As illustrated in FIG. 1, the scanning means 7 causes the ink jet head 5 to perform scanning with reciprocating, in the Y-direction. Specifically, the scanning means 7 includes a pair of guide rails 31 and 32, a carriage 33, and a driving mechanism 34. The guide rails 31 and 32 are provided to extend in the Y-direction. The carriage 33 is supported so as to be able to move on the pair of the guide rails 31 and 32. The driving mechanism 34 moves the carriage 33 in the Y-direction. The transporting means 2 and 3, and the scanning means 7 function as a moving mechanism that relatively moves the ink jet head 5 and the recording medium P.

The driving mechanism 34 is disposed between the guide rails 31 and 32 in the X-direction. The driving mechanism 34 includes a pair of pulleys 35 and 36, an endless belt 37, and a driving motor 38. The pair of pulleys 35 and 36 is arranged at a distance in the Y-direction. The endless belt 37 is wound around the pair of pulleys 35 and 36. The driving motor 38 rotates and drives one pulley 35.

The carriage 33 is linked to the endless belt 37. A plurality of ink jet heads 5 are mounted in the carriage 33. In the embodiment, the plurality of ink jet heads 5 respectively correspond to ink jet heads 5Y, 5M, 5C, and 5K that discharge inks of four colors which are yellow, magenta, cyan, and black. In the embodiment, the ink jet heads 5Y, 5M, 5C, and 5K are disposed side by side in the Y-direction.

Ink Jet Head

Figure 3:
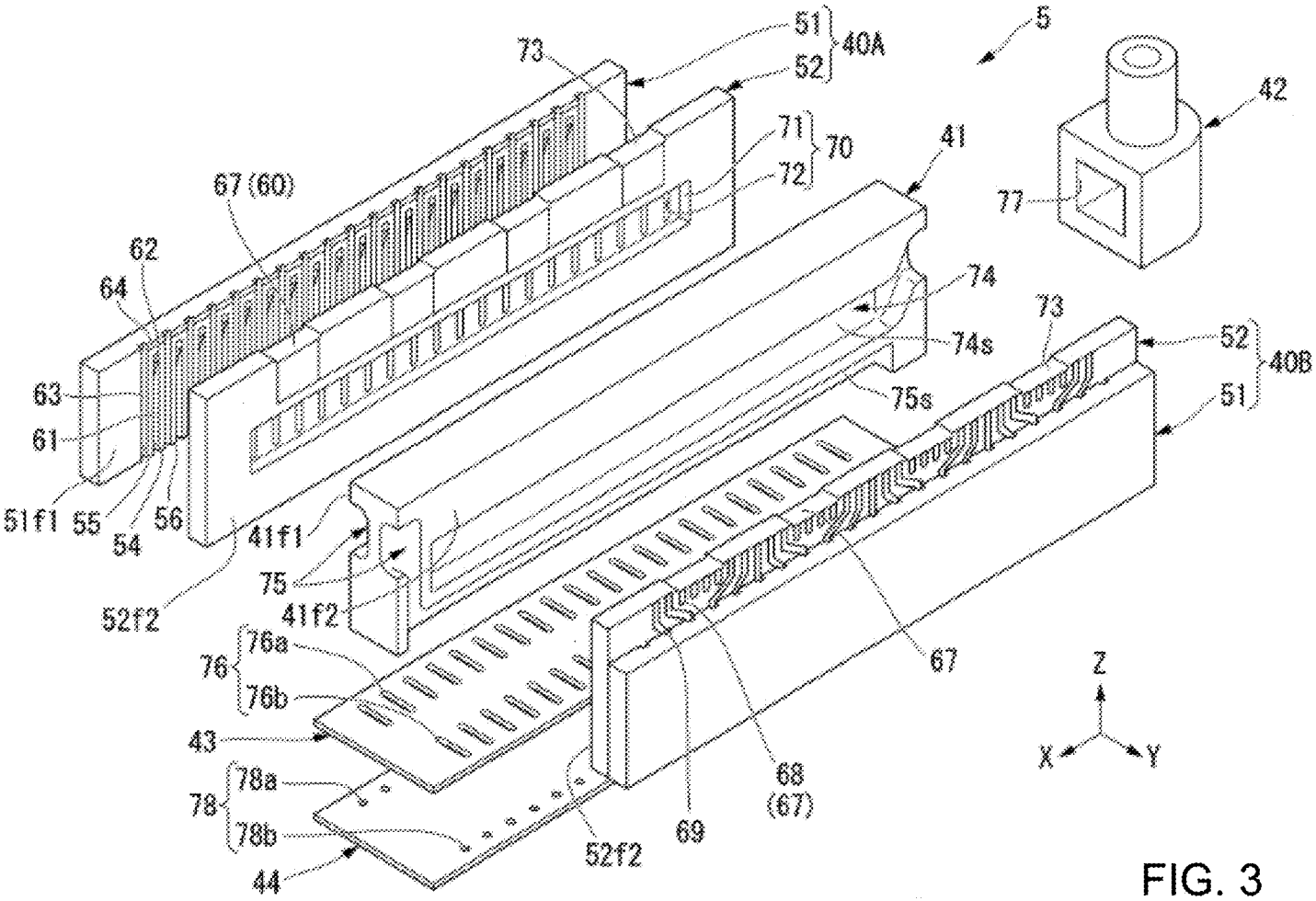
FIG. 3 is an exploded perspective view illustrating the ink jet head in the embodiment.

As illustrated in FIG. 3, the ink jet head 5 includes a pair of head chips 40A and 40B, a flow passage plate 41, an inlet manifold 42, an outlet manifold (not illustrated), a return plate 43, and a nozzle plate (ejection plate) 44. As the ink jet head 5, a circulation type (edge shoot circulation type) of circulating an ink between the ink jet head 5 and the ink tank 4, in a so-called edge shoot type of discharging an ink from the tip end portion of the discharge channel 54 in a channel extension direction is provided.

Head Chip

A pair of head chips 40A and 40B are a first head chip 40A and a second head chip 40B. Descriptions will be made below focusing on the first head chip 40A. In the second head chip 40B, component which are the same as those of the first head chip 40A are denoted by the same reference signs, and detailed descriptions thereof will not be repeated.

The first head chip 40A includes an actuator plate 51 and a cover plate 52.

Actuator Plate

The appearance of the actuator plate 51 is a rectangular plate shape which is long in the X-direction and is short in the Z-direction. In the embodiment, the actuator plate 51 is a so-called Chevron type stacked substrate in which two piezoelectric substrates having polarization directions which are different from each other in a thickness direction (Y-direction) are stacked (see FIG. 6). For example, a ceramics substrate formed of PZT (lead titanate zirconate) or the like is suitably used as the piezoelectric substrate.

A plurality of channels 54 and 55 are formed in a first main surface (actuator plate-side first main surface) of the actuator plate 51 in the Y-direction. In the embodiment, the actuator plate-side first main surface refers to an inner side surface **51*f*1 of the actuator plate 51 in the Y-direction (referred to as "an AP-side-Y-direction inner side surface 51*f*1" below). Here, the inner side in the Y-direction means the center side of the ink jet head 5 in the Y-direction (the flow passage plate 41 side in the Y-direction). In the embodiment, an actuator plate-side second main surface is an outer side surface of the actuator plate 51 in the Y-direction (indicated by the reference sign of 51*f*2** in the drawings).

Each of the channels 54 and 55 is formed to have a straight-line shape which extends in the Z-direction (first direction). The channels 54 and 55 are alternately formed to be spaced from each other in the X-direction (second direction). The channels 54 and 55 are defined from each other by a drive wall 56 formed by the actuator plate 51. One channel 54 is a discharge channel (ejection channel) 54 with which an ink is filled. The other channel 55 is a non-discharge channel (non-ejection channel) 55 with which an ink is not filled.

An upper end portion of the discharge channel 54 is terminated in the actuator plate 51. A lower end portion of the discharge channel 54 is opened in a lower end surface of the actuator plate 51.

Figure 4:
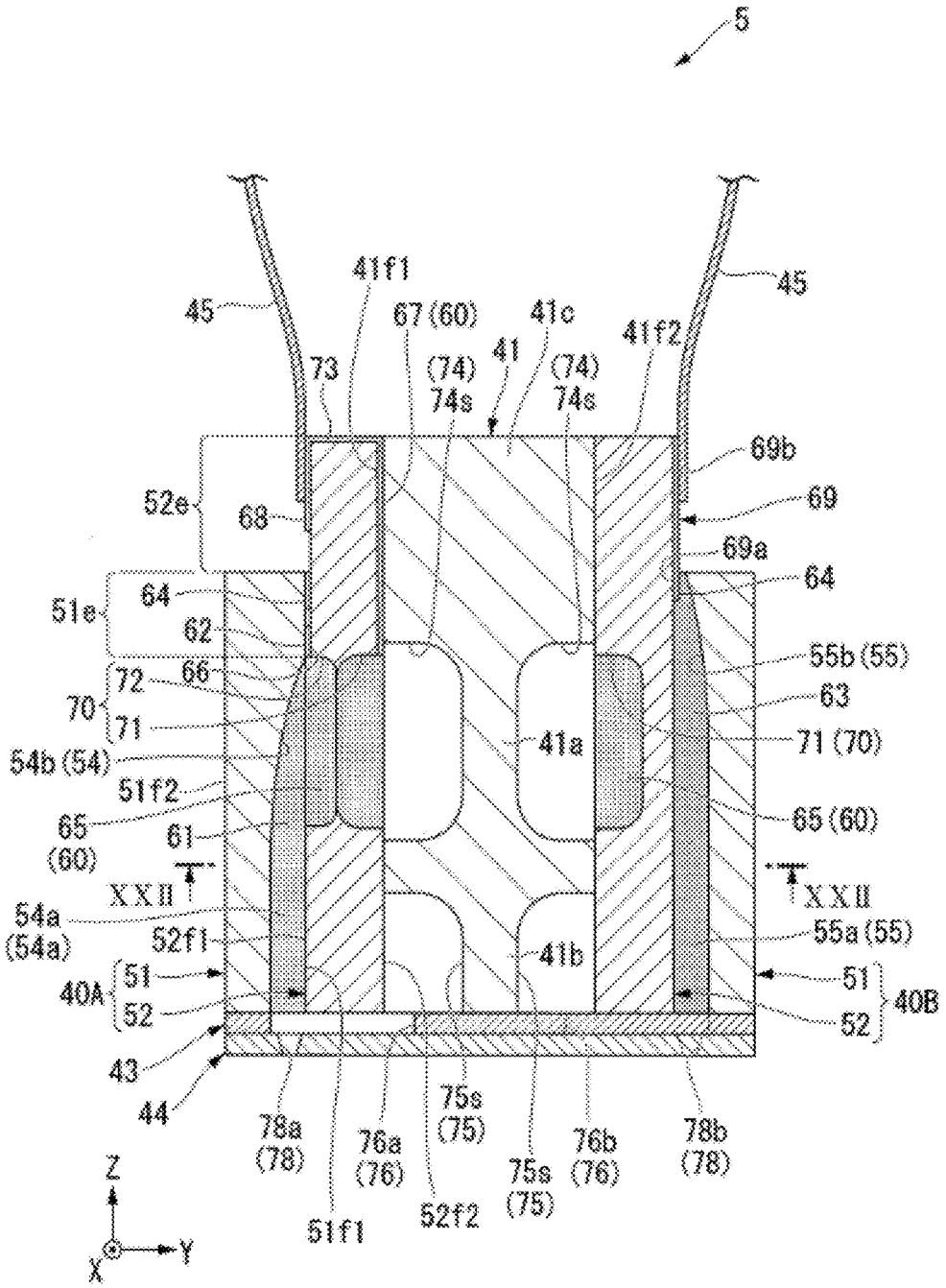
FIG. 4 is a sectional view illustrating the ink jet head in the embodiment.

FIG. 4 is a diagram illustrating a section of the discharge channel 54 in the first head chip 40A.

As illustrated in FIG. 4, the discharge channel 54 includes an extension portion **54*a* positioned at the lower end portion of the discharge channel 54, and a raise-and-cut portion 54*b* which continues upward from the extension portion 54*a***.

The extension portion **54*a* has a groove depth which is constant over the entirety thereof in the Z-direction. The raise-and-cut portion 54*b*** has a groove depth which gradually becomes shallow while raised upwardly.

As illustrated in FIG. 3, an upper end portion of the non-discharge channel 55 is opened in the upper end surface of the actuator plate 51. A lower end portion of the non-discharge channel 55 is opened in the lower end surface of the actuator plate 51.

Figure 5:
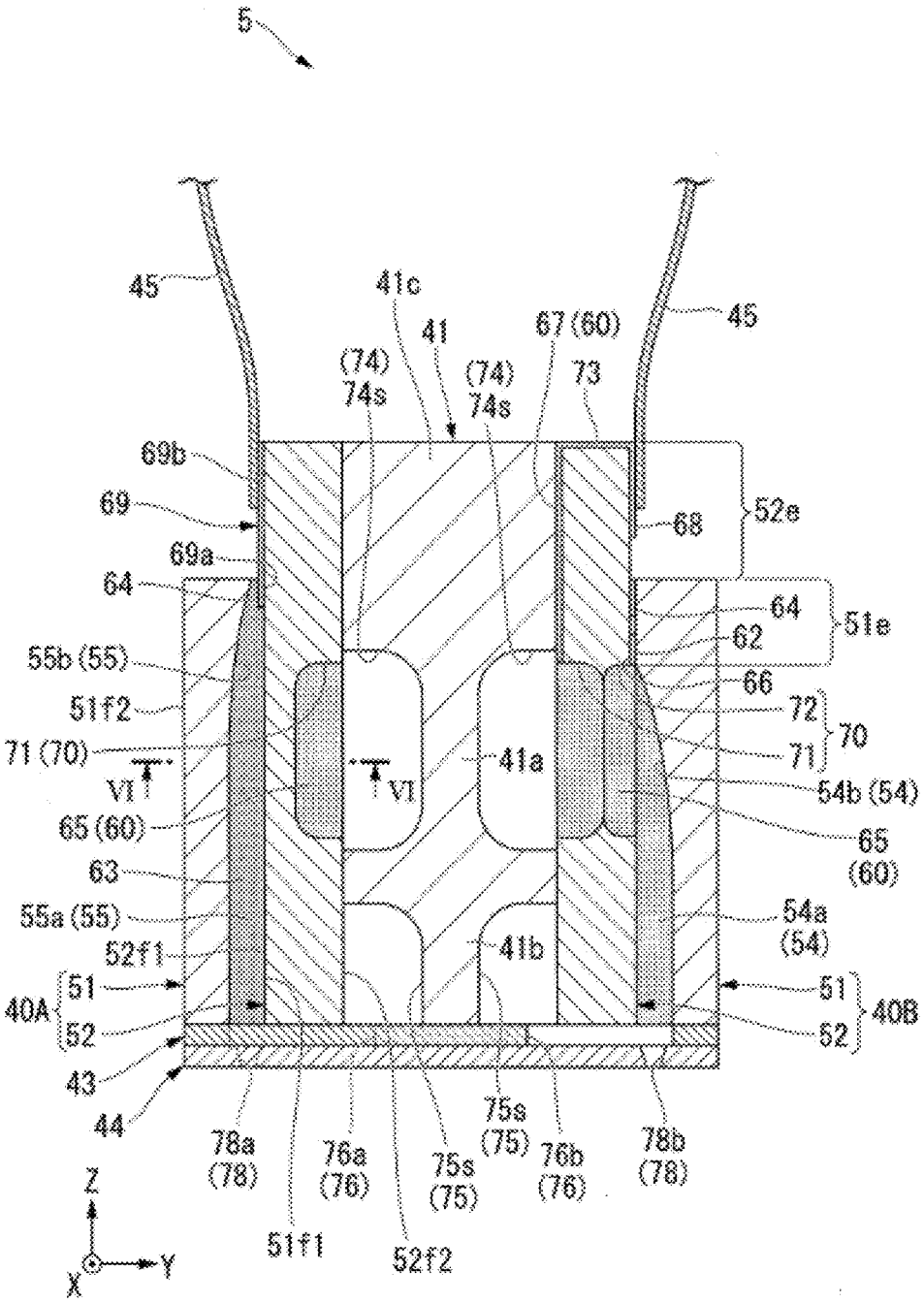
FIG. 5 is a sectional view illustrating the ink jet head in the embodiment.

FIG. 5 is a diagram illustrating a section of the non-discharge channel 55 in the first head chip 40A.

As illustrated in FIG. 5, the non-discharge channel 55 includes an extension portion **55*a* positioned at a lower end portion of the non-discharge channel 55, and a raise-and-cut portion 55*b* which continues upward from the extension portion 55*a***.

The extension portion **55*a* has a groove depth which is constant over the entirety thereof in the Z-direction. The length of the extension portion 55*a* in the non-discharge channel 55 in the Z-direction is longer than the length of the extension portion 54*a* (see FIG. 4) in the discharge channel 54 in the Z-direction. The raise-and-cut portion 55*b* has a groove depth which gradually becomes shallow while raised upwardly. The slope of the raise-and-cut portion 55*b* in the non-discharge channel 55 is substantially the same as the slope of the raise-and-cut portion 54*b* (see FIG. 4) in the discharge channel 54. That is, in the discharge channel 54 and the non-discharge channel 55, a slope start position is different by a difference of the length in the Z-direction between the extension portions 54*a* and 55*a***, but the slope itself (gradient, curvature) is substantially the same as each other.

As illustrated in FIG. 4, a common electrode 61 is formed on an inner surface of the discharge channel 54. The common electrode 61 is formed on the entirety of the inner surface of the discharge channel 54. That is, the common electrode 61 is formed on the entirety of the inner surface of the extension portion 54*a* and on the entirety of the inner surface of the raise-and-cut portion 54*b*.

An actuator plate-side common pad 62 (referred to as "an AP-side common pad 62" below) is formed on an inner side surface of a portion 51*e* (referred to as "an AP-side tail portion 51*e*" below) of the actuator plate 51, which is positioned over the discharge channel 54, in the Y-direction. The AP-side common pad 62 is formed to extend from an upper end of the common electrode 61 to an inner side surface of the AP-side tail portion 51*e* in the Y-direction. That is, the lower end portion of the AP-side common pad 62 is connected to the common electrode 61 in the discharge channel 54. The upper end portion of the AP-side common pad 62 is terminated on the inner side surface of the AP-side tail portion 51*e* in the Y-direction. The AP-side common pad 62 is connected to the common electrode 61. As illustrated in FIG. 3, a plurality of AP-side common pads 62 are disposed to be spaced from each other in the X-direction, on the inner side surface of the AP-side tail portion 51*e* (see FIG. 7) in the Y-direction.

Figure 6:
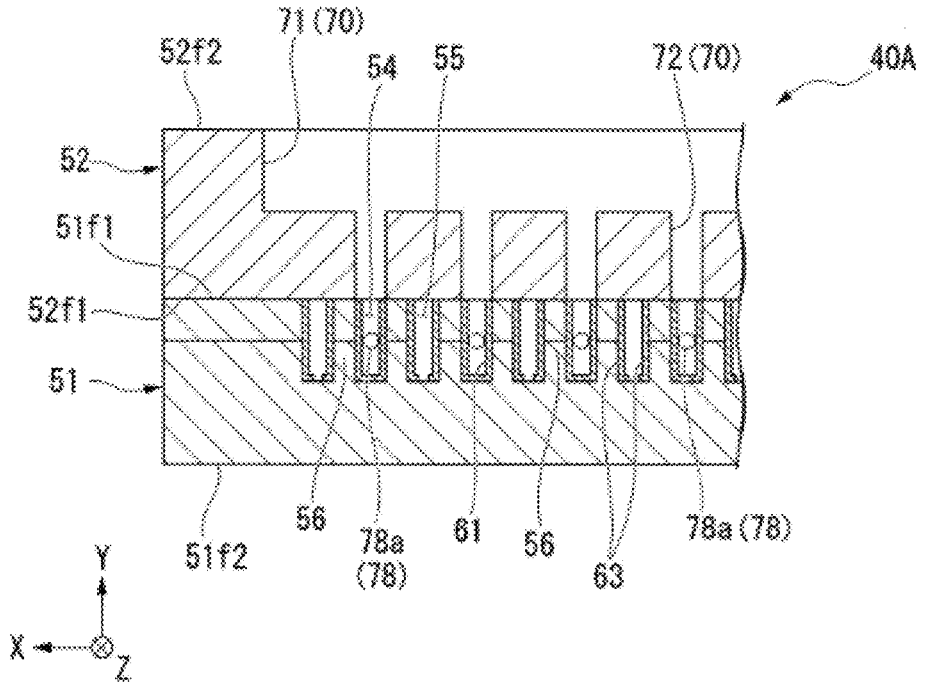
FIG. 6 is a view illustrating a section taken along VI-VI in FIG. 5.

As illustrated in FIG. 5, an individual electrode 63 is formed on an inner surface of the non-discharge channel 55. As illustrated in FIG. 6, individual electrodes 63 are respectively formed on inner side surfaces which face each other in the X-direction, in the inner surface of the non-discharge channel 55. Thus, among individual electrodes 63, individual electrodes 63 which face each other in the same non-discharge channel 55 are electrically isolated on the bottom surface of the non-discharge channel 55. The individual electrode 63 is formed over the entirety (entirety in the Y-direction and the Z-direction) of the inner side surface of the non-discharge channel 55.

As illustrated in FIG. 5, an actuator plate-side individual wiring 64 (referred to as "an AP-side individual wiring 64" below) is formed on the inner side surface of the AP-side tail portion 51*e* in the Y-direction. As illustrated in FIG. 3, regarding the AP-side individual wiring 64, a portion of on the inner side surface of the AP-side tail portion 51*e* (see FIG. 7) in the Y-direction, which is positioned over the AP-side common pad 62 extends in the X-direction. The AP-side individual wiring 64 connects individual electrodes 63 which face each other with the discharge channel 54 interposed between the individual electrodes 63.

Cover Plate

As illustrated in FIG. 3, the appearance of the cover plate 52 is a rectangular plate shape which is long in the X-direction and is short in the Z-direction. The length of the cover plate 52 in a longer side direction is substantially equal to the length of the actuator plate 51 in the longer side direction. The length of the cover plate 52 in a shorter side direction is longer than the length of the actuator plate 51 in the shorter side direction. A first main surface (cover plate-side first main surface) of the cover plate 52, which faces the AP-side-Y-direction inner side surface 51*f*1 is bonded to the AP-side-Y-direction inner side surface 51*f*1. In the embodiment, the cover plate-side first main surface refers to an outer side surface 52*f*1 of the cover plate 52 in the Y-direction (referred to as "a CP-side-Y-direction outer side surface 52*f*1" below). Here, the outer side in the Y-direction means an opposite side of the center side of the ink jet head 5 in the Y-direction (opposite side of the flow passage plate 41 side in the Y-direction). In the embodiment, a cover plate-side second main surface refers to an inner side surface 52*f*2 of the cover plate 52 in the Y-direction (referred to as "a CP-side-Y-direction inner side surface 52*f*2" below).

The cover plate 52 is formed of a material which has insulating properties, and has thermal conductivity which is equal to or greater than that of the actuator plate 51. For example, in a case where the actuator plate 51 is formed of PZT, the cover plate 52 is preferably formed of PZT or silicon. Thus, it is possible to reduce temperature variation in the actuator plate 51 and to cause the temperature of an ink to be uniform. Thus, it is possible to cause a discharge speed of an ink to be uniform and to improve printing stability. In the embodiment, the cover plate 52 is formed by a material having thermal conductivity which is equal to or smaller than the flow passage plate 41.

A liquid supply passage 70 is formed in the cover plate 52. The liquid supply passage 70 penetrates the cover plate 52 in the Y-direction (third direction) and communicates with the discharge channel 54. The liquid supply passage 70 includes a common ink room 71 and a plurality of slits 72. The common ink room 71 is formed in a manner that the inner side of the cover plate 52 is opened in the Y-direction. The plurality of slits 72 communicate with the common ink room 71. The slits 72 are opened in the outer side of the cover plate 52 in the Y-direction and are disposed to be spaced from each other in the X-direction. The common ink room 71 individually communicates with the discharge channels 54 through the slit 72, respectively. The common ink room 71 does not communicate with the non-discharge channel 55.

As illustrated in FIG. 4, the common ink room 71 is formed in the CP-side-Y-direction inner side surface 52*f*2. The common ink room 71 is disposed at a position which is substantially the same as that of the raise-and-cut portion 54*b* of the discharge channel 54, in the Z-direction. The common ink room 71 is formed to have a groove shape which is recessed toward the CP-side-Y-direction outer side surface 52*f*1 side and extends in the X-direction. An ink flows into the common ink room 71 through the flow passage plate 41.

The slits 72 are formed in the CP-side-Y-direction outer side surface 52*f*1. The slits 72 are disposed at positions which face the common ink room 71 in the Y-direction. The slit 72 communicates with the common ink room 71 and the discharge channel 54. The width of the slit 72 in the X-direction is substantially equal to the width of the discharge channel 54 in the X-direction.

In the cover plate 52, a common electrode 65 (referred to as "an in-liquid-supply-passage electrode 65" below) is formed on the inner surface of the liquid supply passage 70. That is, the in-liquid-supply-passage electrode 65 is formed in the entirety of the common ink room 71 and in the entirety of the slit 72.

Figure 7:
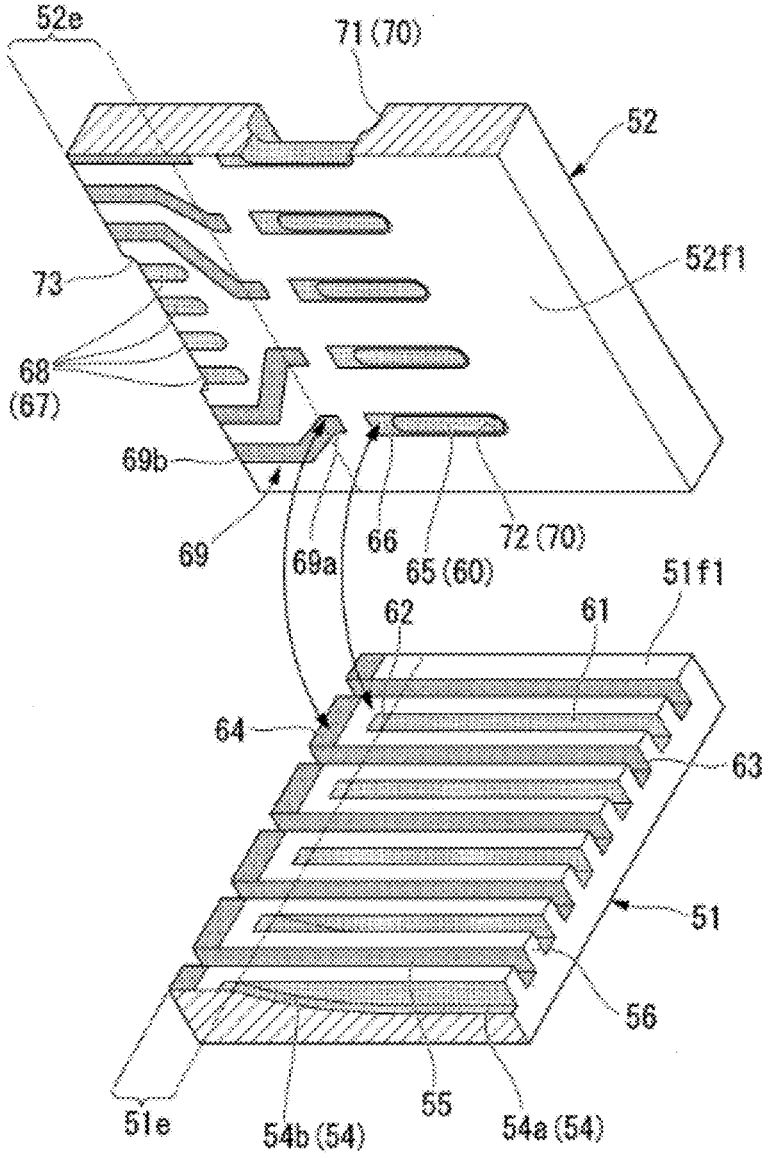
FIG. 7 is an exploded perspective view illustrating a head chip in the embodiment.
Figure 8:
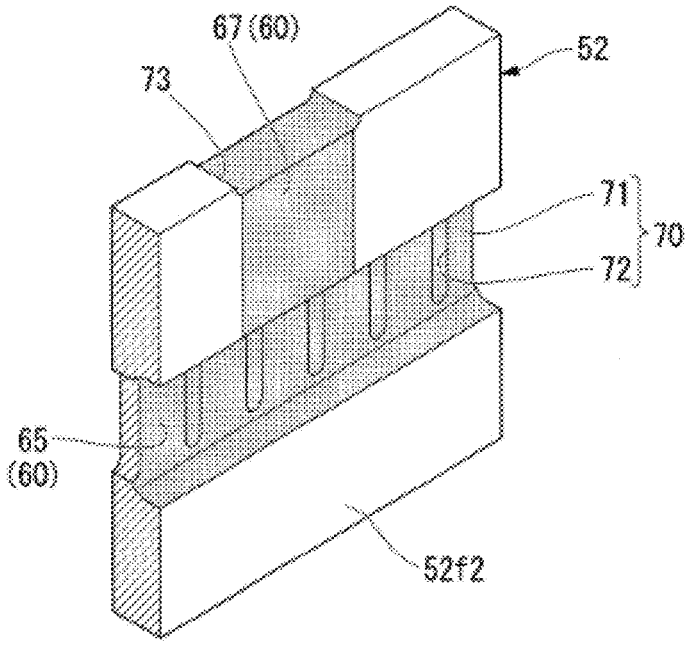
FIG. 8 is a perspective view illustrating a cover plate in the embodiment.

As illustrated in FIG. 7, a common pad 66 on the cover plate side (referred to as "a CP-side common pad 66" below) is formed around the slit 72 in the CP-side-Y-direction outer side surface 52*f*1. As illustrated in FIG. 4, the CP-side common pad 66 is formed to extend from the upper end of the in-liquid-supply-passage electrode 65 toward an upper part of the CP-side-Y-direction outer side surface 52*f*1. That is, the lower end portion of the CP-side common pad 66 is connected to the in-liquid-supply-passage electrode 65 in the slit 72. The upper end portion of the CP-side common pad 66 is terminated on the CP-side-Y-direction outer side surface 52*f*1. The CP-side common pad 66 is continued to the in-liquid-supply-passage electrode 65. A plurality of CP-side common pads 66 are disposed to be spaced from each other on the CP-side-Y-direction outer side surface 52*f*1 in the X-direction (see FIG. 7).

The CP-side common pad 66 faces the AP-side common pad 62 in the Y-direction. As illustrated in FIG. 7, the CP-side common pad 66 is disposed at a position corresponding to the AP-side common pad 62 when the actuator plate 51 and the cover plate 52 are bonded to each other. That is, when the actuator plate 51 and the cover plate 52 are bonded to each other, the CP-side common pad 66 and the AP-side common pad 62 are electrically connected to each other.

As illustrated in FIG. 4, a common lead wiring 67 is formed around the common ink room 71 in the CP-side-Y-direction inner side surface **52*f*2. As illustrated in FIG. 3, a plurality of recess portions 73 are formed at the upper end of the cover plate 52. The recess portions 73 are recessed to the inner side of the cover plate 52 in the Z-direction, and are disposed to be spaced from each other in the X-direction. FIG. 3 illustrates four recess portions 73** which are arranged at a substantially equal interval in the X-direction.

As illustrated in FIG. 4, the common lead wiring 67 extends upwardly on the CP-side-Y-direction inner side surface **52*f*2 from the upper end of the common ink room 71 along the CP-side-Y-direction inner side surface 52*f*2. Then, the common lead wiring 67 is drawn up to the upper end portion of the CP-side-Y-direction outer side surface 52*f*1 along the recess portion 73 at the upper end of the cover plate 52. In other words, the common lead wiring 67 is drawn up to the outer side surface of a portion 52*e* (referred to as "a CP-side tail portion 52*e*" below) of the cover plate 52, which is positioned over the actuator plate 51, in the Y-direction. Thus, the common electrode 61 formed on the inner surface of each of the plurality of discharge channels 54 is electrically connected to a flexible substrate (external wiring) 45 in the common terminal 68, through the AP-side common pad 62, the CP-side common pad 66, the in-liquid-supply-passage electrode 65, and the common lead wiring 67. In the embodiment, the common lead wiring 67 and the in-liquid-supply-passage electrode 65 constitute a connection wiring 60 which connects the common electrode 61 and the flexible substrate 45 to each other. In the connection wiring 60, the common lead wiring 67 is divided and formed at a plurality of places of which the number is equal to or greater than at least 3 in the cover plate 52** in the X-direction.

As illustrated in FIG. 7, the common lead wiring 67 includes common terminals 68 which are divided and formed at a plurality of places of which the number is equal to or greater than at least 3 in the X-direction, on the outer side surface of the CP-side tail portion **52*e* in the Y-direction. In the embodiment, 4 common terminals 68 are arranged to be spaced from each other in the X-direction, on the outer side surface of the CP-side tail portion 52*e* in the Y-direction. The distance between two common terminals 68** which are adjacent to each other is substantially equal.

A cover plate-side individual wiring 69 (referred to as "a CP-side individual wiring 69" below) is formed in the cover plate 52. The CP-side individual wiring 69 is formed to be divided in the X-direction, at the upper end portion of the CP-side-Y-direction outer side surface **52*f*1. The CP-side individual wiring 69 includes a cover plate-side individual pad 69*a* (referred to as "a CP-side individual pad 69*a*" below) and an individual terminal 69*b*. The CP-side individual pad 69*a* is disposed at a position corresponding to the AP-side individual wiring 64 when the actuator plate 51 and the cover plate 52 are bonded to each other. The individual terminal 69*b* is formed in a manner that the individual terminal 69*b* is inclined to be positioned outwardly in the X-direction as coming to the upper side from the CP-side individual pad 69*a*, and then the individual terminal 69*b*** extends to have a straight-line shape.

That is, when the actuator plate 51 and the cover plate 52 are bonded to each other, the CP-side individual pad **69*a* and the AP-side individual wiring 64 are electrically connected to each other. A plurality of CP-side individual pads 69*a* are arranged at a distance in the X-direction. The distance (array pitch) between two CP-side individual pads 69*a* which are adjacent to each other is substantially constant. The plurality of CP-side individual pads 69*a* and a plurality of CP-side common pads 66 face each other one by one in the Z-direction. In other words, each of the CP-side individual pads 69*a* and each of the CP-side common pads 66** are disposed to be aligned on a straight line in the Z-direction.

The individual terminal **69*b* extends to the upper end of the CP-side tail portion 52*e* on the outer side surface thereof in the Y-direction. Thus, the individual electrode 63 formed in the inner surface of each of the non-discharge channels 55 is electrically connected to the flexible substrate 45 (see FIG. 5) on the individual terminal 69*b*, through the AP-side individual wiring 64 and the CP-side individual pad 69*a*. In the embodiment, the outer side surface of the CP-side tail portion 52*e* in the Y-direction is configured to be a connection surface to which the flexible substrate 45** is connected.

A plurality of individual terminals **69*b* are arranged to be spaced from each other in the X-direction. The distance (array pitch) between two individual terminals 69*b* which are adjacent to each other is substantially constant. The plurality of individual terminals 69*b* are arranged between the plurality of common terminals 68 (common terminal groups) which are arranged in the X-direction. The array pitch between the individual terminals 69*b* and the array pitch between the common terminals 68** are substantially equal to each other.

Arrangement Relationship of Pair of Actuator Plates

As illustrated in FIG. 3, the head chips 40A and 40B are arranged to be spaced from each other in the Y-direction, in a state where CP-side-Y-direction inner side surfaces **52*f*2** face each other in the Y-direction.

The discharge channel 54 and the non-discharge channel 55 of the second head chip 40B are arranged so as to be shifted in the X-direction by the half pitch of the array pitch between the discharge channel 54 and the non-discharge channel 55 of the first head chip 40A. That is, the discharge channels 54 of the head chips 40A and 40B are arranged in zigzags, and the non-discharge channel 55 of the head chips 40A and 40B are arranged in zigzags.

That is, as illustrated in FIG. 4, the discharge channel 54 of the first head chip 40A faces the non-discharge channel 55 of the second head chip 40B in the Y-direction. As illustrated in FIG. 5, the non-discharge channel 55 of the first head chip 40A faces the discharge channel 54 of the second head chip 40B in the Y-direction. The pitch between the channels 54 and 55 in each of the head chips 40A and 40B may be appropriately changed.

Flow Passage Plate

The flow passage plate 41 is sandwiched between the first head chip 40A and the second head chip 40B in the Y-direction. The flow passage plate 41 is integrally formed of the same member. As illustrated in FIG. 3, the appearance of the flow passage plate 41 is a rectangular plate shape which is long in the X-direction and is short in the Z-direction. When viewed from the Y-direction, the appearance of the flow passage plate 41 is substantially the same as the appearance of the cover plate 52.

The CP-side-Y-direction inner side surface **52*f*2 in the first head chip 40A is bonded to a first main surface 41*f*1**

(surface directed toward the first head chip 40A side) of the flow passage plate 41 in the Y-direction. The CP-side-Y-direction inner side surface 52*f*2 in the second head chip 40B is bonded to a second main surface 41*f*2 (surface directed toward the second head chip 40B side) of the flow passage plate 41 in the Y-direction.

The flow passage plate 41 is formed of a material which has insulating properties, and has thermal conductivity which is equal to or greater than that of the cover plate 52. For example, in a case where the cover plate 52 is formed of silicon, the flow passage plate 41 is preferably formed of silicon or carbon. Thus, it is possible to reduce temperature variation in the cover plate 52 between the head chips 40A and 40B. Therefore, it is possible to reduce temperature variation in the actuator plate 51 between the head chips 40A and 40B and to cause the temperature of an ink to be uniform. Thus, it is possible to cause a discharge speed of an ink to be uniform and to improve printing stability.

An inlet flow passage 74 and an outlet flow passage 75 are formed in each of the main surfaces 41*f*1 and 41*f*2 of the flow passage plate 41. The inlet flow passage 74 individually communicates with the common ink room 71. The outlet flow passage 75 individually communicates with the circulation passage 76 of the return plate 43. The flow passage plate 41 is formed so as to cause the inlet flow passage 74 and the outlet flow passage 75 to be arranged in the Z-direction. A portion (inlet flow-passage forming member) of the flow passage plate 41, which forms the inlet flow passage 74 is formed of a material having thermal conductivity which is equal to or greater than that of the actuator plate 51. A portion (outlet flow-passage forming member) of the flow passage plate 41, which forms the outlet flow passage 75 is formed of a material having thermal conductivity which is equal to or greater than that of the actuator plate 51. In the embodiment, the flow passage plate 41 is integrally formed of the same member, and is formed of a material having thermal conductivity which is equal to or greater than that of the cover plate 52.

The inlet flow passage 74 is recessed from each of the main surfaces 41*f*1 and 41*f*2 of the flow passage plate 41 toward the inner side thereof in the Y-direction. One end portion of the inlet flow passage 74 in the X-direction is opened in one end surface of the flow passage plate 41 in the X-direction. The inlet flow passage 74 is inclined to be positioned downwardly, as coming to the other end side thereof in the X-direction from one end surface of the flow passage plate 41 in the X-direction. Then, the inlet flow passage 74 is bent toward the other end side thereof in the X-direction, and extends to have a straight-line shape. As illustrated in FIG. 4, the width of the inlet flow passage 74 in the Z-direction is substantially equal to or greater the width of the common ink room 71 in the Z-direction. The width of the inlet flow passage 74 in the Z-direction may be equal to or smaller than the width of the common ink room 71 in the Z-direction.

The inlet flow passage 74 stores an inlet liquid storage portion 74*s* that temporarily stores an ink before the ink flows into the common ink room 71. As illustrated in FIG. 3, the inlet liquid storage portion 74*s* has a vertical width which is maintained to be constant. In the inlet liquid storage portion 74*s*, the vertical center portion of the flow passage plate 41 extends in the X-direction so as to have a straight-line shape.

As illustrated in FIG. 4, the inlet flow passages 74 are arranged between the first head chip 40A and the second head chip 40B in the Y-direction, so as to be spaced from each other in the Y-direction. That is, in the flow passage plate 41, a portion between the inlet flow passages 74 in the Y-direction is partitioned by a wall member. In other words, an inlet flow-passage partition wall 41*a* is provided in the flow passage plate 41. The inlet flow-passage partition wall 41*a* partitions the inlet flow passage 74 into a portion of the first head chip 40A side and a portion of the second head chip 40B side in the Y-direction. Thus, pressure fluctuation in the channel, which occurs when an ink is discharged is blocked by the inlet flow-passage partition wall (wall member) 41*a*. Accordingly, it is possible to suppress the occurrence of so-called crosstalk in which the pressure fluctuation propagates as a pressure wave, to another channel and the like through the flow passage between the head chips 40A and 40B. Thus, it is possible to obtain excellent discharge performance (printing stability).

As illustrated in FIG. 3, the outlet flow passage 75 is recessed from each of the main surfaces 41*f*1 and 41*f*2 of the flow passage plate 41 toward the inner side thereof in the Y-direction, and is recessed upwardly from the lower end surface of the flow passage plate 41. One end portion of the outlet flow passage 75 is opened in the other end surface of the flow passage plate 41 in the X-direction. The outlet flow passage 75 is bent downward from the other end surface of the flow passage plate 41 in the X-direction, so as to have a crank shape. Then, the outlet flow passage 75 extends toward the one end side thereof in the X-direction, so as to have a straight-line shape. As illustrated in FIG. 4, the width of the outlet flow passage 75 in the Z-direction is smaller than the width of the inlet flow passage 74 in the Z-direction. The depth of the outlet flow passage 75 in the Y-direction is substantially equal to the depth of the inlet flow passage 74 in the Y-direction.

The outlet flow passage 75 is connected to the outlet manifold (not illustrated) on the other end surface of the flow passage plate 41 in the X-direction. The outlet manifold is connected to the ink discharge tube 22 (see FIG. 1).

The outlet flow passage 75 includes an outlet liquid storage portion 75*s* which temporarily stores an ink flowing out from the circulation passage 76. As illustrated in FIG. 3, the outlet liquid storage portion 75*s* has a vertical width which is maintained to be constant. In the outlet liquid storage portion 75*s*, the lower end portion of the flow passage plate 41 extends in the X-direction so as to have a straight-line shape.

As illustrated in FIG. 4, the outlet flow passages 75 are arranged between the first head chip 40A and the second head chip 40B in the Y-direction, so as to be spaced from each other in the Y-direction. That is, in the flow passage plate 41, a portion between the outlet flow passages 75 in the Y-direction is partitioned by a wall member. In other words, an outlet flow-passage partition wall 41*b* is provided in the flow passage plate 41. The outlet flow-passage partition wall 41*b* partitions the outlet flow passage 75 into a portion of the first head chip 40A side and a portion of the second head chip 40B side in the Y-direction. Thus, pressure fluctuation in the channel, which occurs when an ink is discharged is blocked by the outlet flow-passage partition wall (wall member) 41*b*. Accordingly, it is possible to suppress the occurrence of so-called crosstalk in which the pressure fluctuation propagates as a pressure wave, to another channel and the like through the flow passage between the head chips 40A and 40B. Thus, it is possible to obtain excellent discharge performance (printing stability).

When the section in FIG. 4 is viewed, the inlet flow passage 74 and the outlet flow passage 75 are not formed at a portion of the flow passage plate 41, which overlaps the CP-side tail portion 52*e* in the Y-direction. That is, the portion of the flow passage plate 41, which overlaps the CP-side tail portion 52*e* in the Y-direction is set to be the solid member 41*c*. Thus, in comparison to a case the portion of the flow passage plate 41, which overlaps the CP-side tail portion 52*e* in the Y-direction is set to be a hollow member, it is possible to avoid poor crimping occurring by a space between members at a time of connection, when the flow passage plate 41 and the cover plate 52 are connected to each other.

Inlet Manifold

As illustrated in FIG. 3, the inlet manifold 42 is collectively bonded to one end surface of the head chips 40A and 40B and the flow passage plate 41 in the X-direction. A supply passage 77 which communicates with each of inlet flow passages 74 is formed in the inlet manifold 42. The supply passage 77 is recessed from the inner end surface of the inlet manifold 42 in the X-direction toward the outside thereof in the X-direction. The supply passage 77 collectively communicates with the inlet flow passages 74. The inlet manifold 42 is connected to the ink supply tube 21 (see FIG. 1).

Return Plate

The appearance of the return plate 43 is a rectangular plate shape which is long in the X-direction and is short in the Y-direction. The return plate 43 is collectively bonded to lower end surfaces of the head chips 40A and 40B and the flow passage plate 41. In other words, the return plate 43 is disposed on the opening end side of the discharge channels 54 in the first head chip 40A and the second head chip 40B. The return plate 43 is a spacer plate which is interposed between the opening ends of the discharge channels 54 in the first head chip 40A and the second head chip 40B, and the upper end of the nozzle plate 44. A plurality of circulation passages 76 that respectively connect the discharge channels 54 in the head chips 40A and 40B to the outlet flow passage 75 are formed in the return plate 43. The plurality of circulation passages 76 include first circulation passages 76*a* and second circulation passages 76*b*. The plurality of circulation passages 76 penetrate the return plate 43 in the Z-direction.

As illustrated in FIG. 4, the first circulation passages 76*a* are formed at positions which are substantially the same as those of the discharge channels 54 of the first head chip 40A in the X-direction, respectively. A plurality of first circulation passages 76*a* are formed to be spaced from each other in the X-direction, corresponding to the array pitch between the discharge channels 54 in the first head chip 40A.

The first circulation passage 76*a* extends in the Y-direction. The inner side end portion of the first circulation passage 76*a* in the Y-direction is positioned on an inner side from the CP-side-Y-direction inner side surface 52*f*2 of the first head chip 40A in the Y-direction. The inner side end portion of the first circulation passage 76*a* in the Y-direction communicates with the inside of the outlet flow passage 75. The outer side end portion of the first circulation passage 76*a* in the Y-direction individually communicates with the inside of the corresponding discharge channel 54 in the first head chip 40A.

The cross-sectional area obtained when a portion of the discharge channel 54 in the first head chip 40A, which faces the return plate 43 is cut out at a plane which is orthogonal to the flowing direction of an ink is referred to as "a channel-side flow passage cross-sectional area" below. Here, the portion of the discharge channel 54 in the first head chip 40A, which faces the return plate 43 means a portion (boundary portion) at which the discharge channel 54 and the first circulation passage 76*a* are in contact with each other. That is, the channel-side flow passage cross-sectional area means an opening area of a downstream side end of the discharge channel 54 of the first head chip 40A in the flowing direction of an ink.

The cross-sectional area obtained when the first circulation passage 76*a* is cut out at a plane which is orthogonal to the flowing direction of an ink is referred to as "a circulation passage-side flow passage cross-sectional area" below. That is, the circulation passage-side flow passage cross-sectional area means a cross-sectional area when the first circulation passage 76 is cut out at a plane which is orthogonal to an extension direction of the first circulation passage 76.

In the embodiment, the circulation passage-side flow passage cross-sectional area is smaller than the channel-side flow passage cross-sectional area. Thus, in comparison to a case where the circulation passage-side flow passage cross-sectional area is greater than the channel-side flow passage cross-sectional area, it is possible to suppress the occurrence of so-called crosstalk (crosstalk from the circulation passage 76 side) in which pressure fluctuation in the channel, which occurs, for example, when an ink is discharged propagates as a pressure wave, to another channel and the like through the flow passage. Thus, it is possible to obtain excellent discharge performance (printing stability).

As illustrated in FIG. 5, the second circulation passages 76*b* are formed at positions which are substantially the same as those of the discharge channels 54 of the second head chip 40B in the X-direction, respectively. A plurality of second circulation passages 76*b* are formed to be spaced from each other in the X-direction, corresponding to the array pitch between the discharge channels 54 in the second head chip 40B.

The second circulation passage 76*b* extends in the Y-direction. The inner side end portion of the second circulation passage 76*b* in the Y-direction is positioned on an inner side from the CP-side-Y-direction inner side surface 52*f*2 of the second head chip 40B in the Y-direction. The inner side end portion of the second circulation passage 76*b* in the Y-direction communicates with the inside of the outlet flow passage 75. The outer side end portion of the second circulation passage 76*b* in the Y-direction individually communicates with the inside of the corresponding discharge channel 54 in the second head chip 40B.

Nozzle Plate

As illustrated in FIG. 3, the appearance of the nozzle plate 44 is a rectangular plate shape which is long in the X-direction and is short in the Y-direction. The appearance of the nozzle plate 44 is substantially the same as the appearance of the return plate 43. The nozzle plate 44 is bonded to the lower end surface of the return plate 43. A plurality of nozzle holes (ejection holes) 78 which penetrate the nozzle plate 44 in the Z-direction are arranged in the nozzle plate 44. The plurality of nozzle holes 78 includes first nozzle holes 78*a* and second nozzle holes 78*b*. The plurality of nozzle holes 78 penetrate the nozzle plate 44 in the Z-direction.

As illustrated in FIG. 4, the first nozzle holes 78*a* are formed at portions of the nozzle plate 44, which face the first circulation passages 76*a* of the return plate 43 in the Z-direction, respectively. That is, the first nozzle holes 78*a* are arranged on a straight line, so as to be spaced from each other in the X-direction and to have a pitch which is the same as that of the first circulation passages 76*a*. The first nozzle hole 78*a* communicates with the inside of the first circulation passage 76*a* at the outer end portion of the first circulation passage 76*a* in the Y-direction. Thus, the first nozzle hole 78*a* communicates with the corresponding discharge channel 54 of the first head chip 40A through the corresponding first circulation passage 76*a*.

As illustrated in FIG. 5, the second nozzle holes 78*b* are formed at portions of the nozzle plate 44, which face the second circulation passages 76*b* of the return plate 43 in the Z-direction, respectively. That is, the second nozzle holes 78*b* are arranged on a straight line, so as to be spaced from each other in the X-direction and to have a pitch which is the same as that of the second circulation passages 76*b*. The second nozzle hole 78*b* communicates with the inside of the second circulation passage 76*b* at the outer end portion of the second circulation passage 76*b* in the Y-direction. Thus, the second nozzle hole 78*b* communicates with the corresponding discharge channel 54 of the second head chip 40B through the corresponding second circulation passage 76*b*.

Meanwhile, the non-discharge channel 55 does not communicate with the nozzle holes 78*a* and 78*b*, and is covered from a lower part by the return plate 43.

Operation Method of Printer

Next, an operation method of the printer 1 in a case where letters, figures, or the like are recorded on a recording medium P by using the printer 1 will be described.

A state where the four ink tanks 4 illustrated in FIG. 1 which respectively have sufficient inks of different colors are sealed is assumed as an initial state. A state where the ink jet head 5 is filled with the inks in the ink tanks 4 through the ink circulation means 6 is assumed.

As illustrated in FIG. 1, if the printer 1 in the initial state is operated, the grit rollers 11 and 13 of the transporting means 2 and 3 rotate so as to transport a recording medium P in a transport direction (X-direction) between the grit rollers 11 and 13, and the pinch rollers 12 and 14. Simultaneous with transporting of the recording medium P, the driving motor 38 rotates the pulleys 35 and 36 so as to operate the endless belt 37. Thus, the carriage 33 moves with reciprocating, in the Y-direction while being guided by the guide rails 31 and 32.

Since the inks of four colors are appropriately discharged to the recording medium P by the ink jet heads 5 during a period when the carriage 33 moves with reciprocating, letters, an image, or the like can be recorded on a recording medium P.

Here, motion of each of the ink jet heads 5 will be described.

In a vertical circulation type ink jet head 5 in the edge shoot type as in the embodiment, firstly, the pressure pump 24 and the suction pump 25 illustrated in FIG. 2 are operated, and thus an ink is caused to flow in the circulation flow passage 23. In this case, the ink flowing in the ink supply tube 21 flows into each of the inlet flow passages 74 of the flow passage plate 41, through the supply passage 77 of the inlet manifold 42 illustrated in FIG. 3. The ink flowing into each of the inlet flow passages 74 passes through the common ink room 71. Then, the ink is supplied into the discharge channels 54 through the slits 72, respectively. The ink flowing into the discharge channels 54 are collected in the outlet flow passage 75 through the circulation passage 76 of the return plate 43. Then, the ink is discharged to the ink discharge tube 22 illustrated in FIG. 2, through the outlet manifold (not illustrated). The ink discharged to the ink discharge tube 22 is brought back to the ink tank 4. Then, the ink is supplied to the ink supply tube 21 again. Thus, the ink is circulated between the ink jet head 5 and the ink tank 4.

If moving with reciprocating is started by the carriage 33 (see FIG. 1), a driving voltage is applied to the electrodes 61 and 63 via the flexible substrate 45. At this time, the driving voltage is applied between the electrodes 61 and 63, in a state where the individual electrode 63 is set to have a driving potential Vdd and the common electrode 61 is set to have a reference potential GND. If the voltage is applied, thickness shear deformation occurs in two drive walls 56 that define the discharge channel 54. Thus, the two drive walls 56 are deformed to protrude toward the non-discharge channel 55 side. That is, since two piezoelectric substrates which are polarized in the thickness direction (Y-direction) are stacked, if the driving voltage is applied, the actuator plate 51 in the embodiment is deformed and bent to have a V-shape by using the intermediate position of the drive wall 56 in the Y-direction, as the center. Thus, the discharge channel 54 deforms as it expands, for example.

If the volume of the discharge channel 54 is increased by the deformation of the two drive walls 56, an ink in the common ink room 71 is guided into the discharge channel 54 through the corresponding slits 72. The ink guided into the discharge channel 54 propagates in the discharge channel 54 in a form of a pressure wave. The driving voltage applied between the electrodes 61 and 63 reaches the zero at a timing when the pressure wave reaches the nozzle hole 78.

Thus, the drive wall 56 is restored, and the volume of the discharge channel 54, which has been temporarily increased returns to the original volume. With this operation, pressure in the discharge channel 54 is increased, and thus the ink is pressurized. As a result, it is possible to discharge the ink from the nozzle hole 78. At this time, when the ink passes through the nozzle hole 78, the ink is discharged in a form of an ink droplet having a droplet shape. Thus, as described above, letters, an image, or the like can be recorded on the recording medium P.

The operation method of the ink jet head 5 is not limited to the above-described details. For example, a configuration in which the drive wall 56 in a normal state is deformed to the inner side of the discharge channel 54, and thus the discharge channel 54 is, for example, recessed toward the inner side thereof may be made. In this case, this configuration may be realized by setting the voltage applied between the electrodes 61 and 63 to a voltage reversed to the above-described voltage, or by setting the polarization direction of the actuator plate 51 to be reversed without changing the applied direction of the voltage. In addition, a pressurized force of an ink when being discharged may increase in a manner that the discharge channel 54 is deformed bulging outwardly, and then deformed recessed to the inner side.

Manufacturing Method of Ink Jet Head

Next, a manufacturing method of the ink jet head 5 will be described. The manufacturing method of the ink jet head 5 in the embodiment includes a head chip production process, a flow-passage plate production process, a various-plate bonding process, and a return-plate-and-like bonding process. The head chip production process may be performed for the head chips 40A and 40B, by using the similar method. Thus, in the following descriptions, the head chip production process for the first head chip 40A will be described.

Head Chip Production Process

In the embodiment, the head chip production process includes a wafer preparation process, a mask pattern forming process, a channel forming process, and an electrode forming process, as processes on the actuator plate side.

Figure 9:
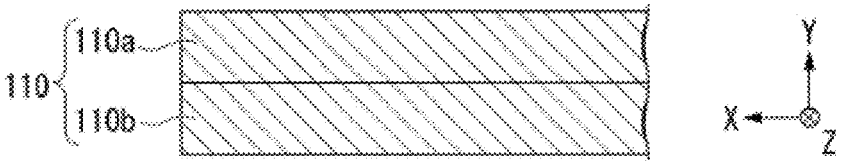
FIG. 9 is a process chart illustrating a wafer preparation process.

As illustrated in FIG. 9, in the wafer preparation process, firstly, two piezoelectric wafers 110*a* and 110*b* which are polarized in a thickness direction (Y-direction) are stacked in a state where a polarization direction is set to be a reverse direction. Thus, a Chevron type actuator wafer 110 is formed.

Then, the front surface (one piezoelectric wafer 110*a*) of the actuator wafer 110 is ground. In the embodiment, a case where the piezoelectric wafers 110*a* and 110*b* having the same thickness are stuck to each other is described. However, piezoelectric wafers 110*a* and 110*b* having a thickness different from each other may be stuck to each other in advance.

Figure 10:
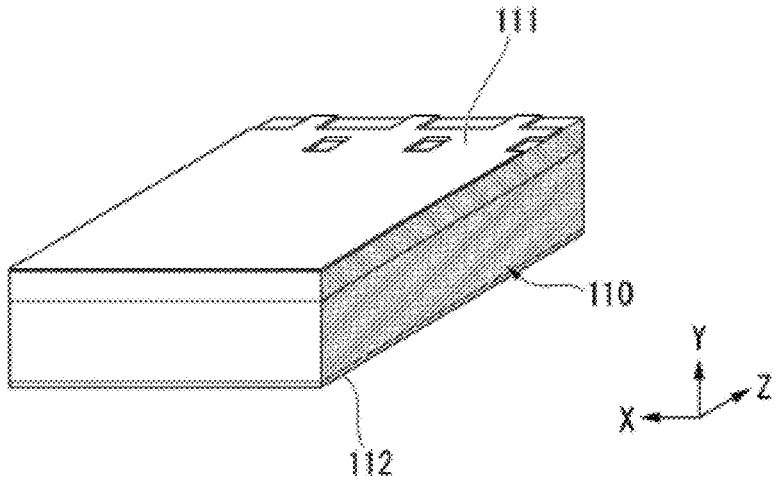
FIG. 10 is a process chart illustrating a mask pattern forming process in the embodiment.

As illustrated in FIG. 10, in the mask pattern forming process, a mask pattern 111 used in the electrode forming process is formed. Specifically, a mounting tape 112 is put on the back surface of the actuator wafer 110. Then, a mask material such as a photosensitive dry film is put on the front surface of the actuator wafer 110. Then, patterning is performed on the mask material by using a photolithography technology, and thus a partial mask material of the mask material, which is positioned in a region for forming the AP-side common pad 62 and the AP-side individual wiring 64 (see FIG. 7) which are described above is removed. Thus, the mask pattern 111 in which at least the region for forming the AP-side common pad 62 and the AP-side individual wiring 64 is opened is formed on the front surface of the actuator wafer 110. In this case, the mask pattern 111 covers a portion of the actuator wafer 110, except for the region for forming the AP-side common pad 62 and the AP-side individual wiring 64. The mask material may be formed, for example, by coating the front surface of the actuator wafer 110.

Figure 11:
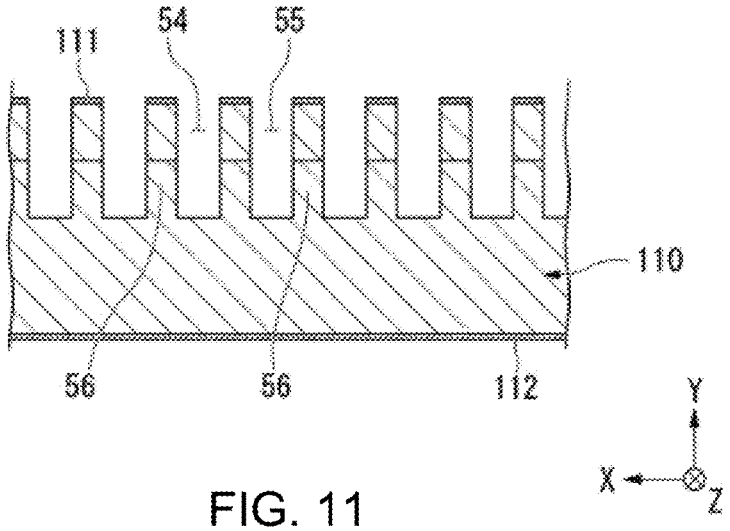
FIG. 11 is a process chart illustrating a channel forming process in the embodiment.
Figure 12:
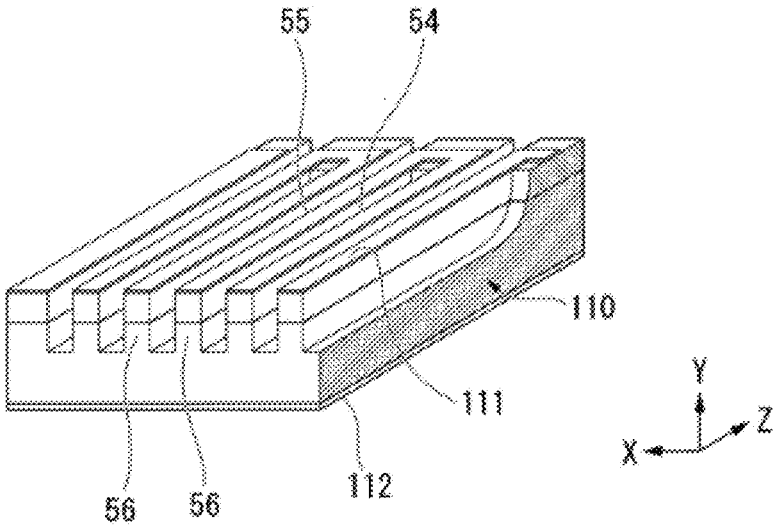
FIG. 12 is a process chart illustrating the channel forming process in the embodiment.

As illustrated in FIG. 11, in the channel forming process, cutting is performed on the front surface of the actuator wafer 110 by a dicing blade and the like (not illustrated). Specifically, as illustrated in FIG. 12, the plurality of channels 54 and 55 are formed on the front surface of the actuator wafer 110, so as to be arranged in parallel at a distance in the X-direction. In this case, a region for forming each of the channels 54 and 55, on the front surface of the actuator wafer 110, is cut out in accordance with the above-described mask pattern 111.

The order of the processes in the mask pattern forming process and the channel forming process which are described above may be reversed so long as the mask pattern 111 can be formed to have a desired shape. In the above-described mask pattern forming process, the mask material at a portion positioned in a region of forming the discharge channels 54 and the non-discharge channels 55 may be removed in advance.

The electrode forming process includes a degreasing process, an etching process, a lead leaching process, a catalyst impartation process, a mask removal process, a plating process, and a plating film removal process.

In the degreasing process, contaminants such as oils and fats, which are attached to the actuator wafer 110 are removed.

In the etching process, the actuator wafer 110 is etched by an ammonium fluoride solution or the like. Thus, an adhesive force between a plating film formed in the plating process, and the actuator wafer 110 is improved.

In the lead leaching process, in a case where the actuator wafer 110 is formed of PZT, lead in the front surface of the actuator wafer 110 is removed. Thus, a catalyst suppression effect of lead on the surface of the actuator wafer 110 is suppressed.

Figure 13:
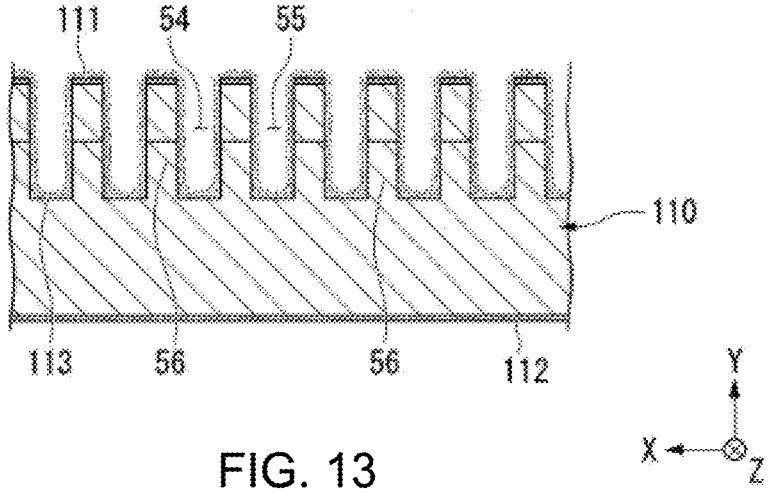
FIG. 13 is a process chart illustrating a catalyst impartation process in the embodiment.

For example, the catalyst impartation process is performed by a sensitizer and activator method. As illustrated in FIG. 13, in the sensitizer and activator method, firstly, a sensitization treatment in which the actuator wafer 110 is immersed in a stannous chloride aqueous solution so as to cause stannous chloride to be attracted to the actuator wafer 110 is performed. Then, the actuator wafer 110 is lightly washed by rinsing or the like. Then, the actuator wafer 110 is immersed in a palladium chloride aqueous solution, so as to cause palladium chloride to be attracted to the actuator wafer 110. If the immersing is performed, an oxidation-reduction reaction occurs between palladium chloride attracted to the actuator wafer 110 and stannous chloride which has been attracted in the above-described sensitization treatment. Thus, metal palladium as a catalyst 113 is precipitated (activating treatment). The catalyst impartation process may be performed plural number of times.

The catalyst impartation process may be performed by a method other than the above-described sensitizer and activator method. For example, the catalyst impartation process may be performed by a catalyst accelerator method. In the catalyst accelerator method, the actuator wafer 110 is immersed in a colloidal solution of tin and palladium. Then, the actuator wafer 110 is immersed in an acidic solution (for example, hydrochloric acid solution) so as to be activated. Thus, metal palladium is precipitated on the front surface of the actuator wafer 110.

Figure 14:
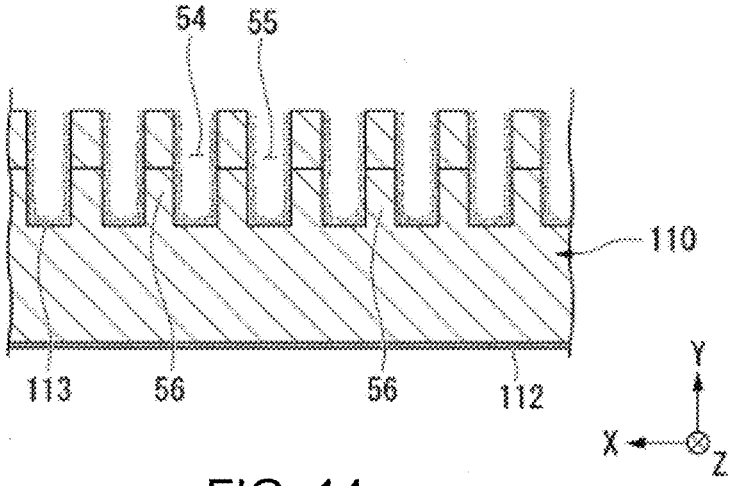
FIG. 14 is a process chart illustrating a mask removal process in the embodiment.

Then, as illustrated in FIG. 14, in the mask removal process, the mask pattern 111 formed on the front surface of the actuator wafer 110 is removed, for example, by lifting-off. A portion of the catalyst 113, which is imparted onto the mask pattern 111 is removed along with the mask pattern 111. That is, in the embodiment, the catalyst 113 remains only at a portion of the actuator wafer 110, which is exposed from the mask pattern 111 (inner surface of each of the channels 54 and 55, the region for forming the AP-side common pad 62 and the AP-side individual wiring 64, and the like). The mask removal process may be performed after the plating process.

Figure 15:
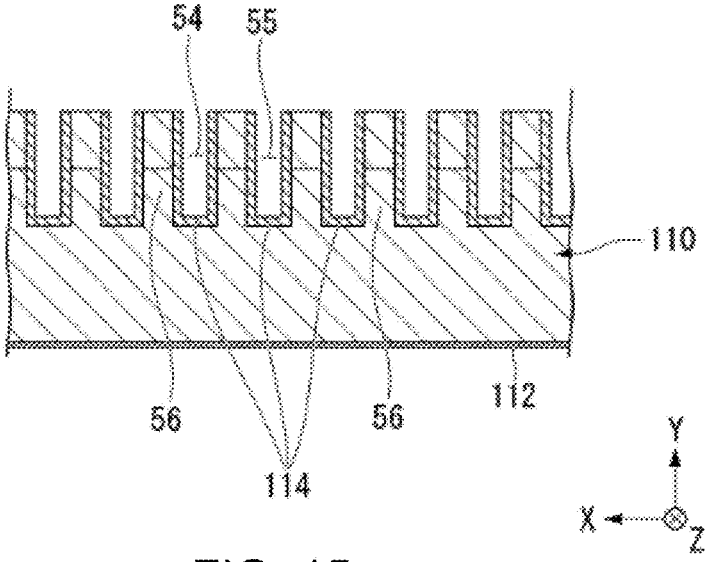
FIG. 15 is a process chart illustrating a plating process in the embodiment.

As illustrated in FIG. 15, in the plating process, the actuator wafer 110 is immersed in a plating solution. If the actuator wafer 110 is immersed in a plating solution, a metal film 114 is formed at the portion of the actuator wafer 110, onto which the catalyst 113 is imparted, by precipitation. As electrode metal used in the plating process, for example, Ni (nickel), Co (cobalt), Cu (copper), Au (gold), and the like are preferable. In particular, Ni is preferably used.

Figure 16:
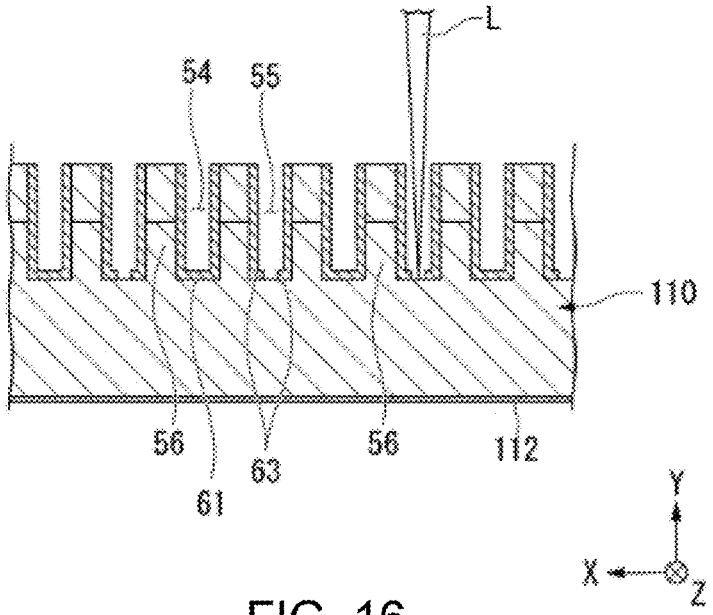
FIG. 16 is a process chart illustrating a plating film removal process in the embodiment.

As illustrated in FIG. 16, in the plating film removal process, a portion of the metal film 114 (see FIG. 15), which is positioned on the bottom surface of the non-discharge channel 55 is removed. Specifically, scanning with a laser beam L is performed in the Z-direction, in a state where the bottom surface of the non-discharge channel 55 is irradiated with the laser beam L. If the scanning is performed, a portion of the metal film 114 (see FIG. 15), which is irradiated with the laser beam L is selectively removed. Thus, the metal film 114 (see FIG. 15) is divided by the bottom surface of the non-discharge channel 55. Accordingly, in the actuator wafer 110, the common electrode 61 and the individual electrode 63 are respectively formed on the inner surfaces of the channels 54 and 55, respectively. The AP-side common pad 62 and the AP-side individual wiring 64 (see FIG. 7) which are connected to the corresponding common electrode 61 and to the corresponding individual electrode 63 are formed on the front surface of the actuator wafer 110.

Instead of the laser beam L, a dicer may be used. The plating film removal process is not limited to removing of the portion of the metal film 114, which is positioned on the bottom surface of the non-discharge channel 55. For example, in the catalyst removal process, a portion of the catalyst 113, which is positioned on the bottom surface of the non-discharge channel 55 may be removed. Specifically, in the catalyst removal process, scanning with a laser beam L may be performed in the Z-direction, in a state where the bottom surface of the non-discharge channel 55 is irradiated with the laser beam L. Thus, the portion of the catalyst 113, which is irradiated with the laser beam L may be selectively removed.

Then, the mounting tape 112 is peeled off, and the actuator wafer 110 is fragmented by using a dicer or the like. Accordingly, the above-described actuator plate 51 (see FIG. 5) is completed.

In the embodiment, the head chip production process includes a common ink room forming process, a slit forming process, a recess portion forming process, and an electrode-and-wiring forming process, as processes of the cover plate side.

Figure 17:
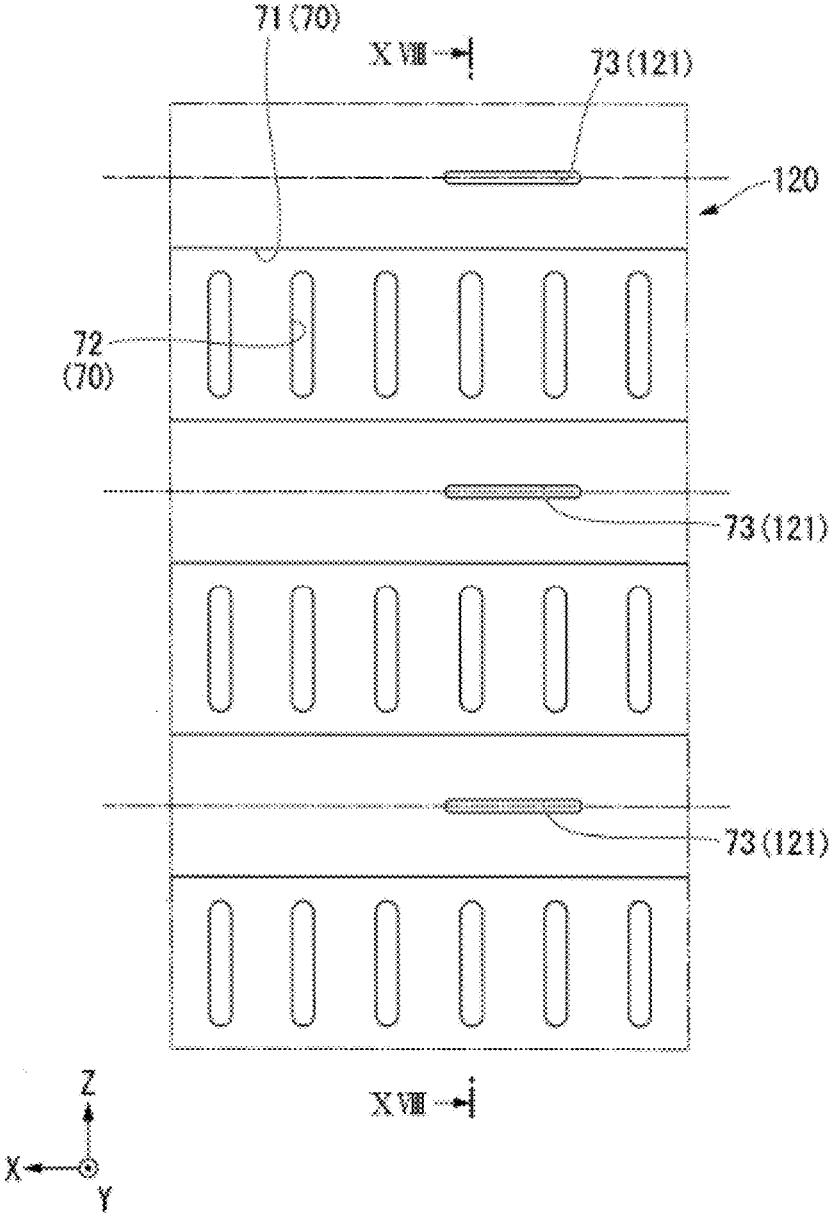
FIG. 17 is a process chart (plan view) illustrating a cover plate production process in the embodiment.

As illustrated in FIG. 17, in the common ink room forming process, sand blasting or the like is performed on a cover wafer 120 from the front surface side, through a mask (not illustrated), and thereby the common ink room 71 is formed.

Figure 18:
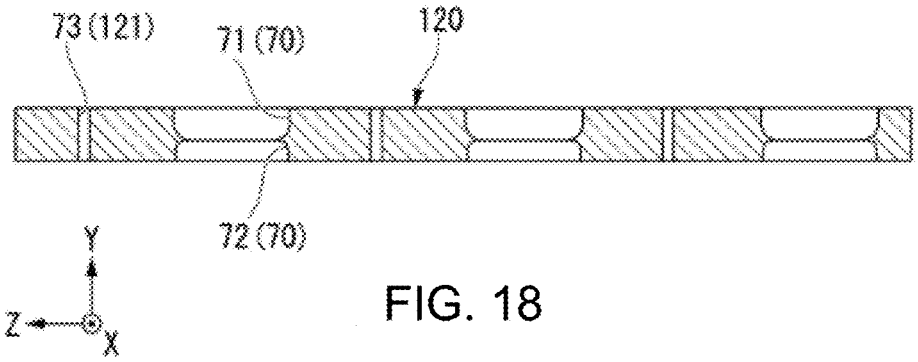
FIG. 18 is a view illustrating a section taken along XVIII-XVIII in FIG. 17.

As illustrated in FIG. 18, in the slit forming process, sand blasting or the like is performed on the cover wafer 120 from the back surface side, through a mask (not illustrated), and thereby slits 72 which individually communicate with the inside of the common ink room 71 are formed.

In the recess portion forming process, as illustrated in FIG. 17, sand blasting or the like is performed on the cover wafer 120 from the front surface side or the back surface side, through a mask (not illustrated), and thereby the slit 121 for forming the recess portion 73 (see FIG. 7) is formed. Then, cover wafer 120 is fragmented along an axis of the slit 121 by using a dicer or the like. Accordingly, the recess portion 73 is formed in the cover wafer 120. Thus, the cover plate 52 (see FIG. 3) in which the recess portion 73 is formed is completed.

Each of the common ink room forming process, the slit forming process, and the recess portion forming process is not limited to sand blasting, and may be performed by dicing, cutting, or the like.

Figure 19:
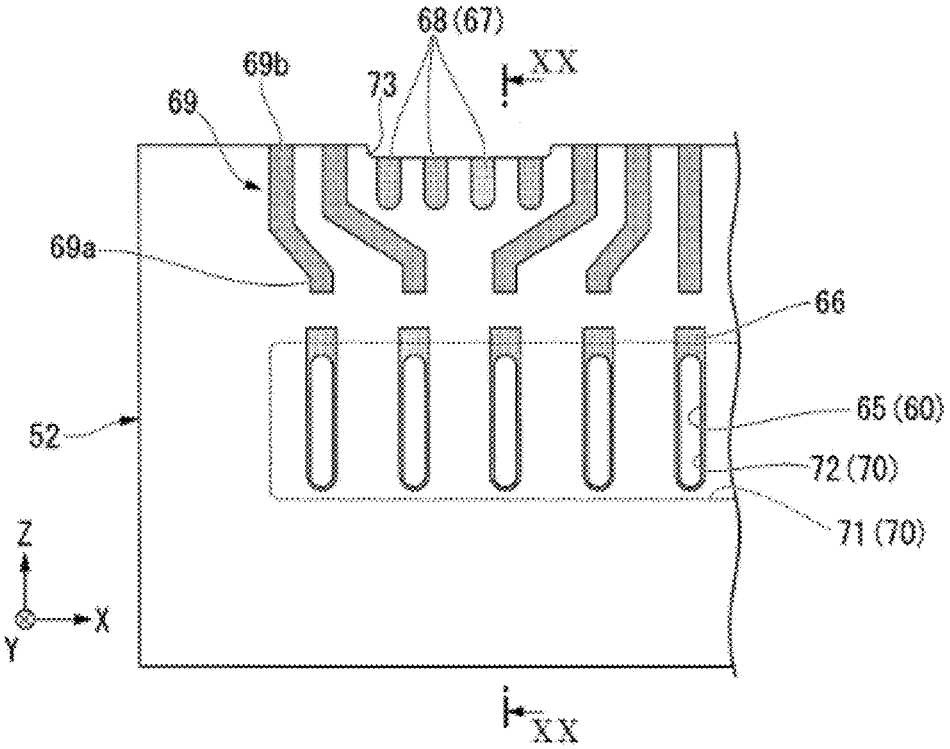
FIG. 19 is a diagram illustrating a common wiring forming process and an individual wiring forming process in the embodiment.

Then, as illustrated in FIG. 19, in the electrode-and-wiring forming process, various electrodes and wirings such as the in-liquid-supply-passage electrode 65, the CP-side common pad 66, the common lead wiring 67, and the CP-side individual wiring 69 are formed in the cover plate 52.

Figure 20:
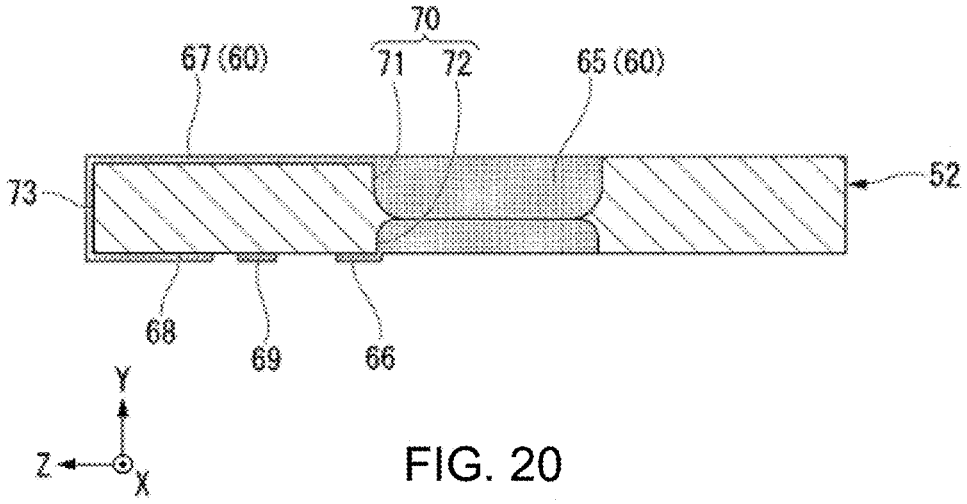
FIG. 20 is a view illustrating a section taken along XX-XX in FIG. 19.

Specifically, in the electrode-and-wiring forming process, as illustrated in FIG. 20, firstly, a mask (not illustrated) is disposed on the entire surface (including the front surface, the back surface, the upper end surface, and a surface in which the recess portion 73 is formed) of the cover plate 52. In the mask, regions for forming various electrodes and various wirings (in-liquid-supply-passage electrode 65, CP-side common pad 66, common lead wiring 67, and CP-side individual wiring 69) are opened. Then, a film of an electrode material is formed on the entire surface of the cover plate 52 by electroless plating or the like. Thus, the film of the electrode material, which will function as the various electrodes and the various wirings is formed on the entire surface of the cover plate 52 through openings of the mask. As the mask, for example, a photosensitive dry film or the like may be used. The electrode-and-wiring forming process is not limited to plating, and may be performed by vapor deposition and the like.

After the electrode-and-wiring forming process ends, the mask is removed from the entire surface of the cover plate 52.

The actuator plates 51 are bonded to the cover plates 52, and thereby the head chips 40A and 40B are produced. Specifically, the AP-side-Y-direction inner side surface **51*f*1 is stuck to the CP-side-Y-direction outer side surface 52*f*1**.

Flow-passage Plate Production Process

In the embodiment, the flow-passage plate production process includes a flow passage forming process and a fragmentation process.

Figure 21:
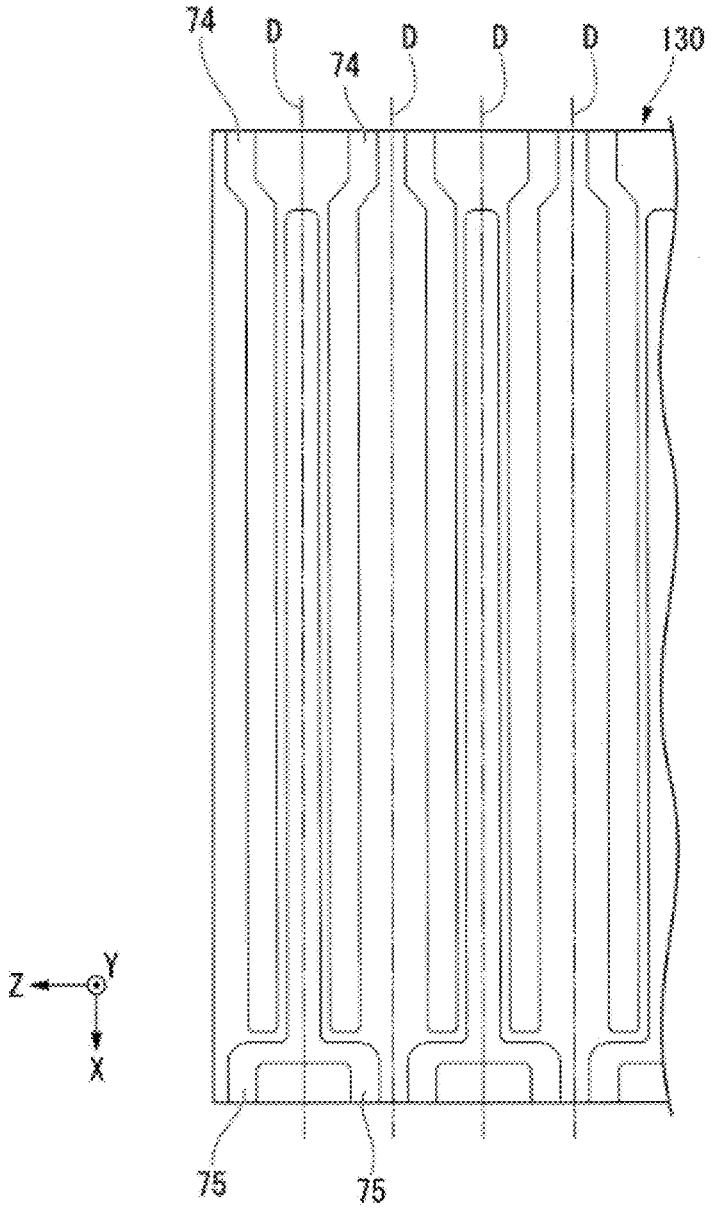
FIG. 21 is a diagram illustrating a flow-passage plate production process in the embodiment.

As illustrated in FIG. 21, in the flow passage forming process (flow passage forming process of the front surface side), sand blasting or the like is performed on a flow passage wafer 130 from the front surface side, through a mask (not illustrated), and thereby the inlet flow passage 74 and the outlet flow passage 75 are formed.

In addition, in the flow passage forming process (flow passage forming process of the back surface side), sand blasting or the like is performed on the flow passage wafer 130 from the back surface side, through a mask (not illustrated), and thereby the inlet flow passage 74 and the outlet flow passage 75 are formed. Each of the processes in the flow passage forming process is not limited to sand blasting, and may be performed by dicing, cutting, and the like.

Then, in the fragmentation process, the flow passage wafer 130 is fragmented by using a dicer or the like. The fragmentation is performed along an axis (virtual line D) of a straight-line portion of the outlet flow passage 75 in the X-direction. Thus, the flow passage plate 41 (see FIG. 3) is completed.

Various-Plate Bonding Process

Figure 22:
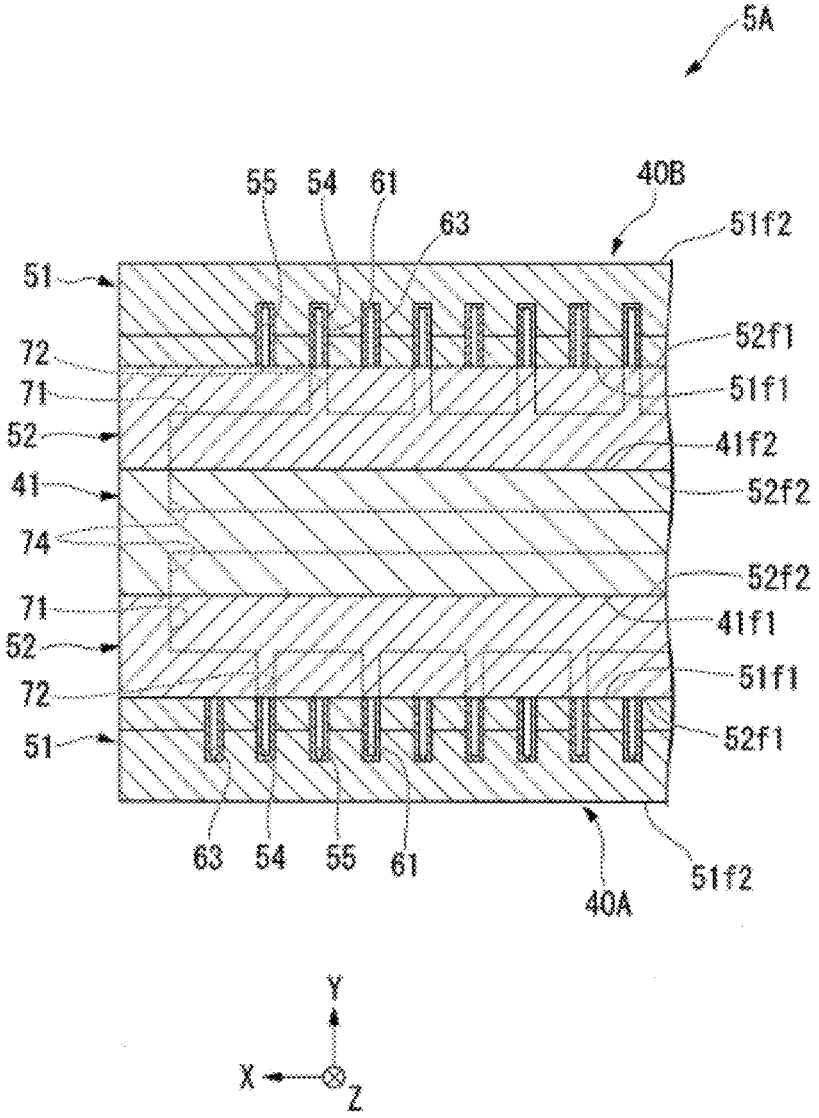
FIG. 22 is a view illustrating a section taken along XXII-XXII in FIG. 4, and is a process chart illustrating a various-plate bonding process.

Then, as illustrated in FIG. 22, in the various-plate bonding process, the cover plates 52 in the head chips 40A and 40B are bonded to the flow passage plate 41. Specifically, the outer side surfaces (main surfaces **41*f*1 and 41*f*2) of the flow passage plate 41 in the Y-direction are stuck to CP-side-Y-direction inner side surfaces 52*f*2 of the head chips 40A and 40**B.

Thus, a plate bonded body 5A is produced.

After all the plates in a wafer state are stuck to each other, chip division (fragmentation) may be performed.

Return-Plate-and-Like Bonding Process

Then, the return plate 43 and the nozzle plate 44 are bonded to the plate bonded body 5A. Then, the flexible substrate 45 (see FIG. 4) is mounted on the CP-side tail portion **52*e***.

With the above processes, the ink jet head 5 in the embodiment is completed.

As described above, the ink jet head 5 according to the embodiment includes the pair of actuator plates 51, the return plate 43, and the flow passage plate 41. The pair of actuator plates 51 are disposed to face each other in the Y-direction. In the actuator plate 51, the plurality of channels 54 and 55 which extend in the Z-direction are arranged at a distance in the X-direction. The return plate 43 is disposed on the opening end side of the channels 54 and 55 in the pair of actuator plates 51. In the return plate 43, the circulation passage 76 which communicates with the channels 54 and 55 is formed. The flow passage plate 41 is disposed between the pair of actuator plates 51. In the flow passage plate 41, the inlet flow passage 74 into which an ink flows, and the outlet flow passage 75 which communicates with the circulation passage 76 are formed to be arranged in the Z-direction.

According to the embodiment, the flow passage plate 41 which is disposed between the pair of actuator plates 51 and in which the inlet flow passage 74 into which an ink flows, and the outlet flow passage 75 which communicates with the circulation passage 76 are formed to be arranged in the Z-direction is provided. Thus, it is possible to concentrate the flow passages of an ink between the pair of actuator plates 51. Therefore, in comparison to a configuration in which an ink is introduced from the outside and the ink is brought back to the outside, two sets of flow passages for an ink are not required, and it is possible to reduce the thickness of the ink jet head 5 (length of the ink jet head 5 in the Y-direction). Accordingly, it is possible to provide an ink jet head 5 which can reduce the thickness and the weight.

In the embodiment, in the ink jet head 5, the inlet flow passage 74 includes the inlet liquid storage portion 74*s* which extends in the X-direction and temporarily stores an ink before the ink is caused to flow into the common ink room 71.

According to the embodiment, since the inlet liquid storage portion 74*s* which extends in the X-direction is provided, it is possible to transfer heat through the ink. Thus, it is easy to cause the temperature of the actuator plate 51 to be uniform.

In the embodiment, in the ink jet head 5, the outlet flow passage 75 includes the outlet liquid storage portion 75*s* which temporarily stores an ink flowing out from the circulation passage 76 and extends in the X-direction.

According to the embodiment, since the outlet liquid storage portion 75*s* which extends in the X-direction is provided, it is possible to transfer heat through the ink. Thus, it is easy to cause the temperature of the actuator plate 51 to be uniform. In the embodiment, since the inlet liquid storage portion 74*s* and the outlet liquid storage portion 75*s* (two liquid storage portions 74*s* and 75*s*) are provided, it is easy to cause the temperature of the actuator plate 51 to be uniform, in comparison to a case where any one of the inlet liquid storage portion 74*s* and the outlet liquid storage portion 75*s* is provided.

In the embodiment, in the ink jet head 5, the inlet flow passage 74 is opened in the one end surface of the flow passage plate 41 in the X-direction.

According to the embodiment, in comparison to a case where the inlet flow passage 74 is opened in the one end surface of the flow passage plate 41 in the Z-direction, it is possible to reduce the length of the ink jet head 5 in the Z-direction, on the inflow side of an ink. In comparison to a case where the inlet flow passage 74 is opened in the one end surface of the flow passage plate 41 in the Y-direction, it is possible to reduce the thickness of the ink jet head 5 on the inflow side of an ink.

In the embodiment, in the ink jet head 5, the outlet flow passage 75 is opened in the other end surface of the flow passage plate 41 in the X-direction.

According to the embodiment, in comparison to a case where the outlet flow passage 75 is opened in the one end surface of the flow passage plate 41 in the Z-direction, it is possible to reduce the length of the ink jet head 5 in the Z-direction, on the outflow side of an ink. In comparison to a case where the outlet flow passage 75 is opened in the one end surface of the flow passage plate 41 in the Y-direction, it is possible to reduce the thickness of the ink jet head 5 on the outflow side of an ink. In the embodiment, since the inlet flow passage 74 is opened in the one end surface of the flow passage plate 41 in the X-direction and the outlet flow passage 75 is opened in the other end surface of the flow passage plate 41 in the X-direction, high practical benefit is obtained in that the length of the ink jet head 5 in the Z-direction and the thickness of the ink jet head 5 are reduced.

In the embodiment, in the ink jet head 5, when the cross-sectional area when a portion of the channels 54 and 55, which faces the return plate 43 is cut out at a plane which is orthogonal to the flowing direction of an ink is set to be the channel-side flow passage cross-sectional area, and the cross-sectional area when the circulation passage 76 is cut out at the plane which is orthogonal to the flowing direction of an ink is set to be the circulation passage-side flow passage cross-sectional area, the circulation passage-side flow passage cross-sectional area is smaller than the channel-side flow passage cross-sectional area.

According to the embodiment, in comparison to a case where the circulation passage-side flow passage cross-sectional area is greater than the channel-side flow passage cross-sectional area, it is possible to suppress the occurrence of so-called crosstalk (crosstalk from the circulation passage 76 side) in which pressure fluctuation in a channel, which occurs, for example, when an ink is discharged propagates as a pressure wave, to another channel and the like through the flow passage. Thus, it is possible to obtain excellent discharge performance (printing stability).

In the embodiment, in the ink jet head 5, an inlet flow-passage partition wall 41*a* which partitions the inlet flow passage 74 into a side of one of the pair of actuator plates 51 and a side of the other of the pair of actuator plates in the Y-direction is provided in the flow passage plate 41.

According to the embodiment, pressure fluctuation in the channel, which occurs when an ink is discharged is blocked by the inlet flow-passage partition wall 41*a*. Accordingly, it is possible to suppress the occurrence of so-called crosstalk in which the pressure fluctuation propagates as a pressure wave, to another channel and the like through the flow passage between the actuator plates 51. Thus, it is possible to obtain excellent discharge performance (printing stability).

In the embodiment, in the ink jet head 5, an outlet flow-passage partition wall 41*b* which partitions the outlet flow passage 75 into the side of the one of the pair of actuator plates 51 and the side of the other of the pair of actuator plates in the Y-direction is provided in the flow passage plate 41.

According to the embodiment, pressure fluctuation in the channel, which occurs when an ink is discharged is blocked by the outlet flow-passage partition wall 41*b*. Accordingly, it is possible to suppress the occurrence of so-called crosstalk in which the pressure fluctuation propagates as a pressure wave, to another channel and the like through the flow passage between the actuator plates 51. Thus, it is possible to obtain excellent discharge performance (printing stability).

In the embodiment, in the ink jet head 5, the inlet flow-passage forming member of the flow passage plate 41, which forms the inlet flow passage 74 is formed of a material having thermal conductivity which is equal to or greater than that of the actuator plate 51.

According to the embodiment, it is possible to reduce temperature variation at a portion of a part between the actuator plates 51, which overlaps the inlet flow-passage forming member of the flow passage plate 41 in the Y-direction, and to cause the temperature of an ink to be uniform. Thus, it is possible to cause a discharge speed of an ink to be uniform and to improve printing stability.

In the embodiment, in the ink jet head 5, the outlet flow-passage forming member of the flow passage plate 41, which forms the outlet flow passage 75 is formed of a material having thermal conductivity which is equal to or greater than that of the actuator plate 51.

According to the embodiment, it is possible to reduce temperature variation at a portion of a part between the actuator plates 51, which overlaps the outlet flow-passage forming member of the flow passage plate 41 in the Y-direction, and to cause the temperature of an ink to be uniform. Thus, it is possible to cause a discharge speed of an ink to be uniform and to improve printing stability.

In the embodiment, in the ink jet head 5, the flow passage plate 41 is integrally formed of the same member.

According to the embodiment, in comparison to a case where the flow passage plate 41 is formed by an assembly of a plurality of members, it is possible to reduce manufacturing man-hours of the flow passage plate 41. In addition, in comparison to a case where the flow passage plate 41 is formed by an assembly of a plurality of members, it is possible to improve dimensional accuracy of the flow passage plate 41. In the embodiment, since the entirety of the flow passage plate 41 is formed of a material having thermal conductivity which is equal to or greater than that of the actuator plate 51, it is possible to reduce temperature variation at a portion of a part between the actuator plates 51, which overlaps the flow passage plate 41 in the Y-direction, and to cause the temperature of an ink to be uniform. Thus, it is possible to cause a discharge speed of an ink to be uniform and to further improve printing stability.

In the embodiment, the ink jet head 5 may further include a pair of cover plates 52 which is disposed to face each other in the Y-direction with the flow passage plate 41 interposed between the pair of cover plates 52. In the cover plate 52, the liquid supply passage 70 which penetrates in the Y-direction and communicates with the channels 54 and 55 is formed. The cover plate 52 is stacked on the AP-side-Y-direction inner side surface **51*f*1 so as to close the plurality of channels 54 and 55**.

According to the embodiment, since the pair of cover plates 52 are further included, it is possible to concentrate flow passages of an ink, which includes the liquid supply passage 70, between the pair of actuator plates 51. Therefore, in comparison to a configuration in which an ink is introduced from the outside and the ink is brought back to the outside, it is possible to reduce the thickness of the ink jet head 5 as thin as possible.

In the embodiment, in the ink jet head 5, the cover plate 52 is formed of a material having thermal conductivity which is equal to or greater than that of the actuator plate 51 and is equal to or smaller than that of the flow passage plate 41.

According to the embodiment, it is possible to reduce temperature variation at a portion of a part between the actuator plates 51, which overlaps the cover plate 52 in the Y-direction, and to cause the temperature of an ink to be uniform. Thus, it is possible to cause a discharge speed of an ink to be uniform and to improve printing stability.

In the embodiment, in the ink jet head 5, the CP-side-Y-direction outer side surface **52*f*1 is configured to be the connection surface to which the flexible substrate 45** is connected.

According to the embodiment, in comparison to a case where the CP-side-Y-direction inner side surface **52*f*2 is configured to be the connection surface, it is possible to easily perform connection work between the flexible substrate 45 and an electrode terminal (common terminal 68 and the individual terminal 69*b***) on the connection surface.

In the embodiment, in the ink jet head 5, the CP-side tail portion **52*e* of the cover plate 52, which has the connection surface and extends out of one end surface of the actuator plate 51 in the Z-direction in a stacked state of the actuator plate 51 and the cover plate 52 may be provided in the cover plate 52. A portion of the flow passage plate 41, which overlaps the CP-side tail portion 52*e* in the Y-direction may be set to be the solid member 41*c***.

According to the embodiment, in comparison to a case the portion of the flow passage plate 41, which overlaps the CP-side tail portion **52*e* in the Y-direction is set to be a hollow member, it is possible to avoid poor crimping occurring by a space between members at a time of connection, when the flow passage plate 41 and the cover plate 52 are connected to each other. For example, when the flow passage plate 41 and the cover plate 52 are connected to each other, it is possible to avoid an occurrence of cracks, chipping, or the like in the flow passage plate 41**.

In the embodiment, in the ink jet head 5, the CP-side-Y-direction outer side surface **52*f*1 is configured to be the connection surface to which the flexible substrate 45 is connected. The CP-side tail portion 52*e* of the cover plate 52, which has the connection surface and extends out of the one end surface of the actuator plate 51 in the Z-direction in a stacked state of the actuator plate 51 and the cover plate 52 is provided in the cover plate 52. The portion of the flow passage plate 41, which overlaps the CP-side tail portion 52*e* in the Y-direction is set to be the solid member 41*c***.

According to the embodiment, in comparison to a case where the CP-side-Y-direction inner side surface **52*f*2 is configured to be the connection surface, it is possible to easily perform connection work between the flexible substrate 45 and an electrode terminal (common terminal 68 and the individual terminal 69*b*) on the connection surface. In addition, in comparison to a case where the portion of the flow passage plate 41, which overlaps the CP-side tail portion 52*e* in the Y-direction is set to be a hollow member, it is possible to avoid poor crimping occurring by a space between members at a time of connection, when the flow passage plate 41 and the cover plate 52 are connected to each other. For example, when the flow passage plate 41 and the cover plate 52 are connected to each other, it is possible to avoid an occurrence of cracks, chipping, or the like in the flow passage plate 41**.

The printer 1 according to the embodiment includes the above-described ink jet head 5, and moving mechanisms 2, 3, and 7 that relatively move the ink jet head 5 and a recording medium P.

According to the embodiment, in the printer 1 which includes the two-row type ink jet head 5, it is possible to reduce the thickness and the weight of the ink jet head 5. Since the thickness of the ink jet head 5 is reduced, the ink jet head 5 easily operates. Thus, it is possible to improve convenience. Since the weight of the ink jet head 5 is reduced, required power of a driving source such as a motor is reduced. Thus, low power consumption, reduction in size of a motor, and the like are realized, and thus it is possible to reduce cost.

The technical range of the present invention is not limited to the above-described embodiment. Various modifications may be added in a range without departing from the gist of the present invention.

For example, in the above-described embodiment, as an example of the liquid ejecting apparatus, the ink jet printer 1 is described as an example. However, it is not limited to the printer. For example, a fax machine, an on-demand printer, and the like may be used as the liquid ejecting apparatus.

In the above-described embodiment, the two-row type ink jet head 5 in which two rows of nozzle holes 78 are arranged is described. However, it is not limited thereto. For example, an ink jet head 5 in which the number of rows of nozzle holes is equal to or greater than three may be provided, or an ink jet head 5 in which one row of nozzle holes is arranged may be provided.

In the above-described embodiment, a configuration in which the discharge channels 54 and the non-discharge channels 55 are alternately arranged is described. However, it is not limited to only this configuration. For example, the present invention may be applied to a so-called three-cycle type ink jet head in which an ink is discharged from all channels in order.

In the above-described embodiment, a configuration in which the Chevron type is used as the actuator plate is described. However, it is not limited thereto. That is, an actuator plate of a monopole type (polarization direction is one in the thickness direction) may be used.

In the above-described embodiment, a configuration in which the inlet flow passage 74 is opened in the one end surface of the flow passage plate 41 in the X-direction is described. However, it is not limited to only this configuration. For example, the inlet flow passage 74 may be opened in one end surface of the flow passage plate 41 in the Z-direction, or the inlet flow passage 74 may be opened in one end surface of the flow passage plate 41 in the Y-direction.

In the above-described embodiment, a configuration in which the outlet flow passage 75 is opened in the outer end surface of the flow passage plate 41 in the X-direction is described. However, it is not limited to only this configuration. For example, the outlet flow passage 75 may be opened in one end surface of the flow passage plate 41 in the Z-direction, or the outlet flow passage 75 may be opened in one end surface of the flow passage plate 41 in the Y-direction.

In the above-described embodiment, a configuration in which the circulation passage-side flow passage cross-sectional area is smaller than the channel-side flow passage cross-sectional area is described. However, it is not limited to only this configuration. For example, the circulation passage-side flow passage cross-sectional area may be set to be equal to or greater than the channel-side flow passage cross-sectional area.

In the above-described embodiment, a configuration in which the CP-side-Y-direction outer side surface **52*f*1 is configured to be the connection surface of the flexible substrate 45 is described. However, it is not limited to only this configuration. For example, the CP-side-Y-direction inner side surface 52*f*2** may be configured to be the connection surface.

In the above-described embodiment, a configuration in which the portion of the flow passage plate 41, which overlaps the CP-side tail portion **52*e* in the Y-direction is set to be the solid member 41*c* is described. However, it is not limited to only this configuration. For example, the portion of the flow passage plate 41, which overlaps the CP-side tail portion 52*e*** in the Y-direction may be set to be a hollow member.

In the above-described embodiment, a configuration in which the flow passage plate 41 is integrally formed of the same member is described. However, it is not limited to only this configuration. For example, the flow passage plate 41 may be formed by an assembly of a plurality of members.

In the following modification examples, components which are the same as those in the embodiment are denoted by the same reference signs, and descriptions thereof will not be repeated.

FIRST MODIFICATION EXAMPLE

Figure 23:
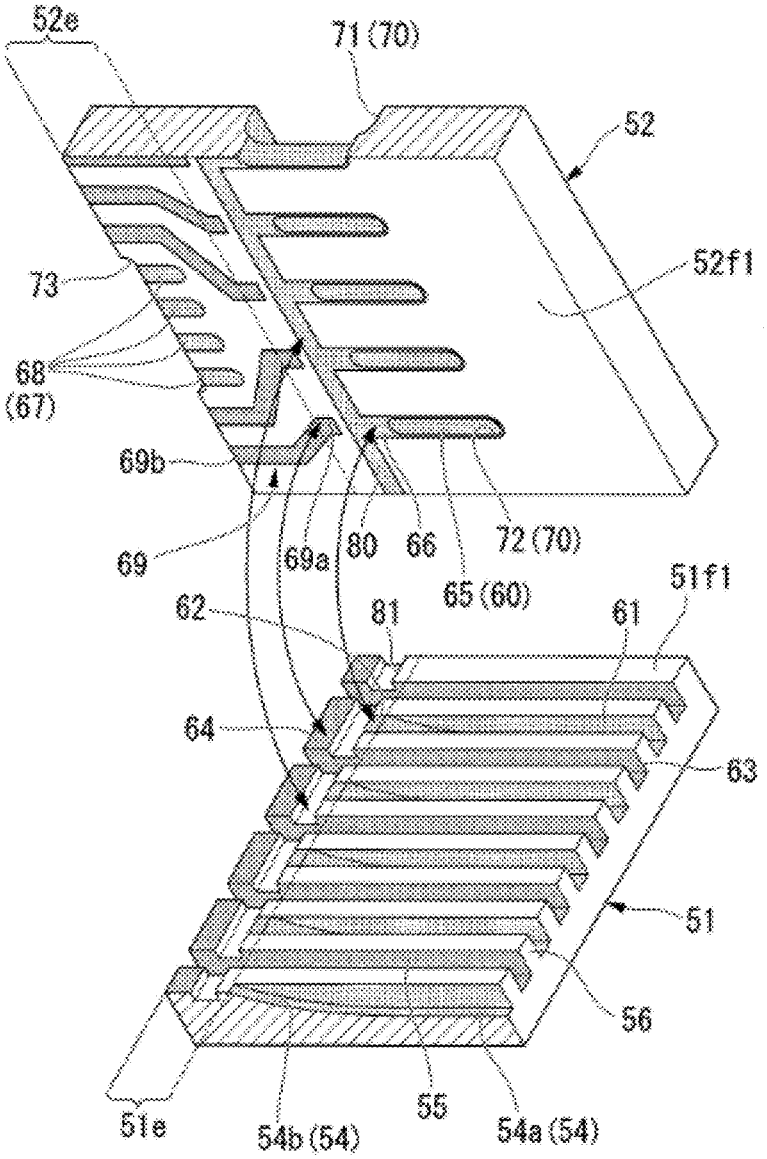
FIG. 23 is an exploded perspective view illustrating a head chip according to a first modification example of the embodiment.

For example, as illustrated in FIG. 23, a transverse common electrode 80 which is connected to the plurality of CP-side common pads 66 may be formed on the CP-side-Y-direction outer side surface **52*f*1. In the transverse common electrode 80, a portion of the CP-side-Y-direction outer side surface 52*f*1, which is positioned between the slit 72 and the CP-side individual pad 69*a* extends in the X-direction. The transverse common electrode 80 is formed to have a band shape in the X-direction, on the CP-side-Y-direction outer side surface 52*f*1. The transverse common electrode 80 is connected to upper end portions of the plurality of CP-side common pads 66, on the CP-side-Y-direction outer side surface 52*f*1. The transverse common electrode 80 does not abut on the CP-side individual pad 69*a*, on the CP-side-Y-direction outer side surface 52*f*1**.

A clearance groove 81 (referred to as "an electrode clearance groove 81" below) of the transverse common electrode 80 may be formed in the inner side surface of the AP-side tail portion **51*e* in the Y-direction. In the electrode clearance groove 81, a portion of the inner side surface of the AP-side tail portion 51*e* in the Y-direction, which is positioned between the AP-side common pad 62 and the AP-side individual wiring 64 extends in the X-direction. The electrode clearance groove 81 faces the transverse common electrode 80 in the Y-direction. The electrode clearance groove 81 is disposed at a position corresponding to that of the transverse common electrode 80 when the actuator plate 51 and the cover plate 52 are bonded to each other. That is, when the actuator plate 51 and the cover plate 52 are bonded to each other, the transverse common electrode 80 is disposed in the electrode clearance groove 81**.

In this modification example, the transverse common electrode 80 which is connected to the plurality of CP-side common pads 66 and extends in the X-direction is formed on the CP-side-Y-direction outer side surface **52*f*1**.

According to this modification example, it is possible to preliminarily connect the plurality of CP-side common pads 66 by the transverse common electrode 80. Thus, it is possible to improve reliability for electrical connection of the plurality of CP-side common pads 66, in comparison to a case where the plurality of CP-side common pads 66 are connected to only the in-liquid-supply-passage electrode 65.

In this modification example, the electrode clearance groove 81 which extends in the X-direction and faces the transverse common electrode 80 in the Y-direction is formed in the inner side surface of the AP-side tail portion **51*e*** in the Y-direction.

According to this modification example, when the actuator plate 51 and the cover plate 52 are bonded to each other, the transverse common electrode 80 can be accommodated in the electrode clearance groove 81. Thus, it is possible to avoid an occurrence of short circuit between the electrode on the actuator plate 51 side (for example, AP-side individual wiring 64), and the transverse common electrode 80.

SECOND MODIFICATION EXAMPLE

Figure 24:
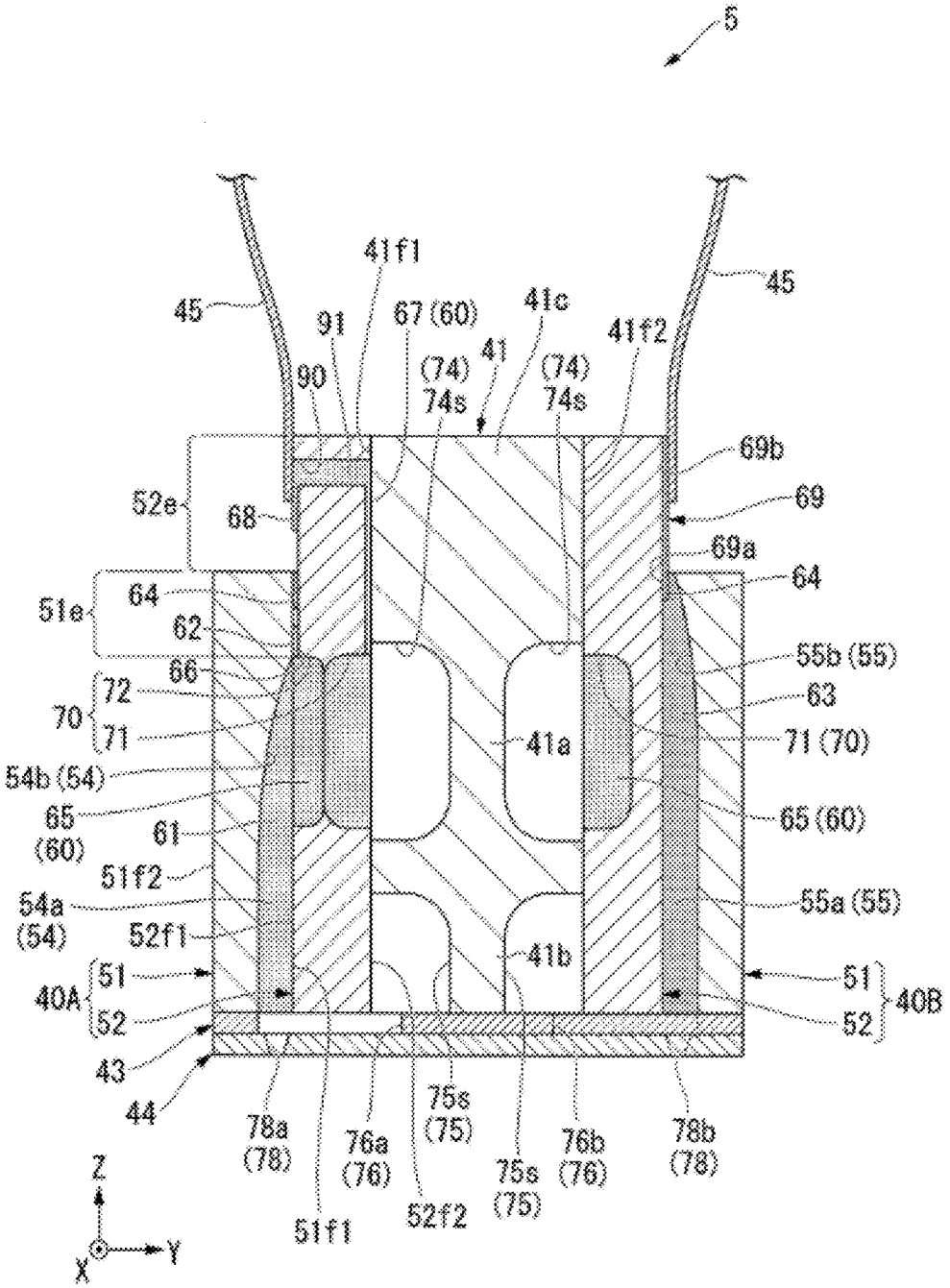
FIG. 24 is a sectional view illustrating an ink jet head according to a second modification example of the embodiment.

For example, as illustrated in FIG. 24, instead of the recess portion 73 (see FIG. 4) in the embodiment, a plurality of through-holes 90 may be formed at the upper end portion of the cover plate 52. The through-holes penetrate in the Y-direction and are arranged to be spaced from each other in the X-direction.

The common lead wiring 67 extends upwardly on the CP-side-Y-direction inner side surface **52*f*2 from the upper end of the common ink room 71 along the CP-side-Y-direction inner side surface 52*f*2. Then, the common lead wiring 67 is drawn up to the upper end portion of the CP-side-Y-direction outer side surface 52*f*1 through the through-hole 90 at the upper end portion of the cover plate 52. In other words, the common lead wiring 67 is drawn up to the outer side surface of the CP-side tail portion 52***e* in the Y-direction, through a through-electrode 91 in the through-hole 90. Thus, common electrodes 61 formed on the inner surface of each of the plurality of discharge channels 54 is electrically connected to the flexible substrate 45 in the common terminal 68, through the AP-side common pad 62, the CP-side common pad 66, the in-liquid-supply-passage electrode 65, and the common lead wiring 67.

For example, the through-electrode 91 is formed only on an inner circumferential surface of the through-hole 90 by vapor deposition or the like. The through-hole 90 may be full of the through-electrode 91 by using a conductive paste or the like.

In this modification example, the plurality of through-holes 90 which penetrate the cover plate 52 in the Y-direction and are arranged to be spaced from each other in the X-direction are formed at the upper end portion of the CP-side tail portion 52*e*. The common lead wiring 67 is connected to the in-liquid-supply-passage electrode 65 and the flexible substrate 45 through the through-hole 90.

According to this modification example, in comparison to a case where the common lead wiring 67 is connected to the in-liquid-supply-passage electrode 65 and the flexible substrate 45 along the recess portion 73 (see FIG. 4), it is possible to protect the common lead wiring 67 by a portion of forming the through-hole (wall portion). Thus, it is possible to avoid an occurrence of a situation in which the common lead wiring 67 in the through-hole 90 is damaged.

In addition, in the range without departing from the gist of the present invention, the components in the above-described embodiment may be appropriately substituted with known components, or the above-described modification examples may be appropriately combined.

What is claimed is:

1. A liquid ejecting head comprising:

a pair of actuator plates in which a plurality of channels which extend in a first direction are arranged at a distance in a second direction which is orthogonal to the first direction, the actuator plates being disposed to face each other in a third direction orthogonal to the first direction and the second direction;

a nozzle plate provided with a nozzle hole configured to eject liquid in the channels;

a return plate which is disposed between the actuator plate and the nozzle plate in the first direction and on an opening end side of the channels in the pair of actuator plates, and in which a circulation passage communicating with the channels is formed; and a flow passage plate which is disposed between the pair of actuator plates, and in which an inlet flow passage into which the liquid flows and an outlet flow passage which communicates with the circulation passage are formed to be arranged in the first direction, wherein part of the liquid provided in the channel is ejected from the nozzle hole, while the rest thereof is discharged through the outlet flow passage from the liquid ejecting head.

2. The liquid ejecting head according to claim 1, wherein the inlet flow passage includes an inlet liquid storage portion which extends in the second direction and temporarily stores the liquid before the liquid flows into at least one of the channels.

3. The liquid ejecting head according to claim 1, wherein the outlet flow passage includes an outlet liquid storage portion which extends in the second direction and temporarily stores a liquid flowing out from the circulation passage.

4. The liquid ejecting head according to claim 1, wherein the inlet flow passage is opened on one end surface of the flow passage plate in the second direction.

5. The liquid ejecting head according to claim 1, wherein the outlet flow passage is opened on the other end surface of the flow passage plate in the second direction.

6. The liquid ejecting head according to claim 1, wherein, when a cross-sectional area of at least one of the channels when a portion of the at least one of the channels, which faces the return plate, is cut out along a plane orthogonal to a flowing direction of the liquid is set to be a channel-side flow passage cross-sectional area, and a cross-sectional area of the circulation passage when the circulation passage is cut out along a plane orthogonal to the flowing direction of the liquid is set to be a circulation passage-side flow passage cross-sectional area, the circulation passage-side flow passage cross-sectional area is smaller than the channel-side flow passage cross-sectional area.

7. The liquid ejecting head according to claim 1, wherein an inlet flow-passage partition wall is provided in the flow passage plate, and the inlet flow-passage partition wall partitions the inlet flow passage into a side of one of the pair of actuator plates and a side of the other of the pair of actuator plates in the third direction.

8. The liquid ejecting head according to claim 1, wherein an outlet flow-passage partition wall is provided in the flow passage plate, and the outlet flow-passage partition wall partitions the outlet flow passage into a side of one of the pair of actuator plates and a side of the other of the pair of actuator plates in the third direction.

9. The liquid ejecting head according to claim 1, wherein an inlet flow-passage forming member which forms the inlet flow passage in the flow passage plate is formed of a material having thermal conductivity which is equal to or greater than that of the actuator plate.

10. The liquid ejecting head according to claim 1, wherein an outlet flow-passage forming member which forms the outlet flow passage in the flow passage plate is formed of a material having thermal conductivity which is equal to or greater than that of the actuator plate.

11. The liquid ejecting head according to claim 1, wherein the flow passage plate is integrally formed of a member.

12. The liquid ejecting head according to claim 1, further comprising a pair of cover plates which is disposed to face each other in the third direction with the flow passage plate interposed between the pair of cover plates, and in which a liquid supply passage which penetrates the cover plate in the third direction and communicates with at least one of the channels is formed, the cover plate being stacked on a first main surface of the actuator plate in the third direction so as to close the plurality of channels in the actuator plate.

13. The liquid ejecting head according to claim 12, wherein the cover plate is formed of a material having thermal conductivity which is equal to or greater than that of the actuator plate and is equal to or smaller than that of the flow passage plate.

14. The liquid ejecting head according to claim 12, wherein a first main surface of the cover plate on a side which is opposite to the flow passage plate side in the third direction is configured to be a connection surface to which an external wiring is connected, a tail portion of the cover plate, which has the connection surface and extends out of one end surface of the actuator plate in the first direction in a stacked state of the actuator plate and the cover plate is provided in the cover plate, and a portion of the flow passage plate, which overlaps the tail portion in the third direction is configured to be a solid member.

15. A liquid ejecting apparatus comprising:

the liquid ejecting head according to claim 1; and a moving mechanism that relatively moves the liquid ejecting head and a recording medium.

* * * * *